US006000689A

United States Patent [19]

Furuki et al.

[11] Patent Number: 6,000,689

[45] Date of Patent: Dec. 14, 1999

[54] AUTOMATIC PAPER FEEDER

[75] Inventors: Ichiro Furuki; Takaaki Kase; Masahiko Shimizu; Keiichi Fukazawa; Yousuke Kobayashi, all of Tokyo, Japan

[73] Assignee: Mitsubishi Denki Kabushiki Kaisha, Tokyo, Japan

[21] Appl. No.: 08/684,436

[22] Filed: Jul. 17, 1996

[30] Foreign Application Priority Data

| | | | |
|---|---|---|---|
| Jul. 18, 1995 | [JP] | Japan | 7-181671 |
| Mar. 18, 1996 | [JP] | Japan | 8-061189 |

[51] Int. Cl.[6] ..... B65H 5/00

[52] U.S. Cl. ..... 271/10.11; 271/122; 271/125; 271/126; 271/127

[58] Field of Search ..... 271/10.09, 10.11, 271/117, 118, 121, 125, 126, 127, 10.13, 122

[56] References Cited

U.S. PATENT DOCUMENTS

| | | | |
|---|---|---|---|
| 4,494,747 | 1/1985 | Graef et al. | 271/263 |
| 4,588,182 | 5/1986 | Nakanishi | 271/121 |
| 4,925,177 | 5/1990 | Nakamura et al. | 271/110 |
| 5,351,945 | 10/1994 | Asakawa et al. | 271/118 |
| 5,358,230 | 10/1994 | Ikemori et al. | 271/121 |
| 5,593,150 | 1/1997 | Katayanagi et al. | 271/121 |

FOREIGN PATENT DOCUMENTS

| | | | |
|---|---|---|---|
| 58-017034 | 2/1983 | Japan . | |
| 60-252537 | 12/1985 | Japan . | |
| 61-106339 | 5/1986 | Japan . | |
| 0166447 | 7/1986 | Japan | 271/125 |
| 62-004147 | 1/1987 | Japan . | |
| 62-295844 | 12/1987 | Japan . | |
| 63-154546 | 10/1988 | Japan . | |
| 1-269568 | 10/1989 | Japan . | |
| 1-294126 | 11/1989 | Japan . | |
| 2-221033 | 4/1990 | Japan . | |
| 2-221033 | 9/1990 | Japan . | |
| 4-246038 | 9/1992 | Japan . | |
| 326581 | 2/1958 | Switzerland | 271/122 |

*Primary Examiner*—H. Grant Skaggs
*Attorney, Agent, or Firm*—Rothwell, Figg, Ernst & Kurz

[57] ABSTRACT

An automatic paper feeder comprises: a pick roller for picking out paper accommodated in a paper cassette; a separation roller to which a torque limiter is connected, and which separates the paper picked out by the pick roller to feed the paper one sheet at a time; means for moving the separation roller into contact with or away from the pick roller; a lifter for lifting the paper accommodated in the paper cassette to cause the paper to be moved into contact with or away from the pick roller; and means for driving the lifter. The means for moving the separation roller into contact with or away from the pick roller and the means for driving the lifter are realized by a single driving means.

3 Claims, 24 Drawing Sheets

AUTOMATIC PAPER FEEDER

BACKGROUND OF THE INVENTION

The present invention relates to an automatic paper feeder for an image forming apparatus, such as a printer, a copying machine, and facsimile equipment.

FIG. 39 is a cross sectional view illustrating a conventional automatic paper feeder disclosed in, for example, Japanese Patent Application Laid-Open No. 221033/1990. In the drawing, reference numeral 1 denotes paper; 2 denotes a paper cassette for accommodating the paper 1; 3 denotes a pick roller for picking out the paper 1 in the paper cassette 2; 4 denotes a separation roller for separating the sheets of paper 1 picked out by the pick roller 3 and feeding the paper 1 one sheet at a time; and 5 denotes a coil spring serving as an urging means for causing the paper 1 in the paper cassette 2 to abut against the pick roller 3.

Next, a description will be given of the operation. A leading end portion of the paper 1 in the paper cassette 2 is pushed upward by the coil spring 5, and an uppermost sheet of paper 1 abuts against a lower surface portion of the pick roller 3. In addition, the separation roller 4 is disposed in such a manner as to rotate in contact with the pick roller 3. When the pick roller 3 is rotated in the traveling direction of the paper in the above-described state, the paper 1 is taken out from inside the paper cassette 2.

In cases where one sheet of paper 1 has been taken out from inside the paper cassette 2, since the force for transporting the paper 1 due to a frictional force between the pick roller 3 and the paper 1 is set in such a manner as to overcome the separating torque of the separation roller 4 acting in the direction of the arrow indicated by the broken line, the separation roller 4 rotates by following the rotation of the pick roller 3, thereby feeding the paper 1 to an ensuing step.

In the event that two sheets of paper 1 have been taken out from inside the paper cassette 2, since the separating torque of the separation roller 4 is set in such a manner as to overcome the frictional force between the two sheets of paper 1, the separation roller 4 separates the sheets of paper 1 by rotating in the direction of the arrow indicated by the broken line, thereby feeding only one sheet of paper 1 to the ensuing step.

However, with the arrangement of the automatic paper feeder shown in FIG. 39, since the separation roller 4 constantly abuts against the pick roller 3, the following drawback has been encountered. If the separated paper 1 is not returned to inside the paper cassette 2 and remains located in the vicinity of a paper separating portion 19, i.e., a portion of contact between the pick roller 3 and the separation roller 4, unless the rotation of the pick roller 3 is stopped immediately after a trailing end of the paper 1, fed out in the form of only one sheet after being separated, has passed the separating portion 19, an overlapped feeding of paper can occur in which the separated paper 1 remaining in the vicinity of the separating portion 19 is also transported by following the paper 1 fed out in the form of only one sheet after being separated.

In addition, since a rotational torque is constantly produced in the separation roller 4 in an opposite direction to the traveling direction of the paper 1, if the separation roller 4 is in the state in which the separation roller 4 constantly abuts against the pick roller 3, there is a possibility that a difference in speed can occur between the traveling speed of the paper 1 and the peripheral speed of the separation roller 4 at the surface of contact between the paper 1 and the separation roller 4 when one sheet of paper 1 is being transported. Hence, there has been a drawback in that defects, such as damage or roller scars caused to the paper 1, can occur due to the difference in speed.

In addition, with the arrangement of the automatic paper feeder shown in FIG. 39, since the leading end portion of the paper 1 in the paper cassette 2 is constantly pushed upward by the coil spring 5, and an uppermost sheet of paper 1 constantly abuts against a lower surface portion of the pick roller 3, there is a drawback in that an overlapped feeding of the paper can occur because there is always a possibility of the paper 1 in the paper cassette 2 being taken out while the pick roller 3 is rotating in the traveling direction of the paper 1.

In addition, since the arrangement provided is such that the paper 1 in the paper cassette 2 is pushed upward by the coil spring 5, and the paper 1 is made to abut against the lower surface portion of the pick roller 3,, the pressure-contacting force at the time when the paper 1 is brought into contact with the lower surface portion of the pick roller 3 is determined by the coil spring 5. Further, the pressure-contacting force varies depending on the amount of the paper 1 loaded in the paper cassette 2 and the kind of paper 1, so that there are limitations to the kinds of paper that can be used.

In addition, because the force with which the pick roller 3 takes out the paper 1 from the interior of the paper cassette 2 is unstable, there has been a problem in that the misfeeding of the paper can possibly occur.

SUMMARY OF THE INVENTION

The present invention has been made to overcome the above-described problems, and its object is to provide at low cost an automatic paper feeder which is capable of picking out the paper 1 from inside the paper cassette 2 without overlapped feeding and misfeeding and without causing defects, such as scars, to the surface of the paper, and which is capable of coping with various kinds of paper 1 having different characteristics, without impairing the paper separating characteristic.

An automatic paper feeder in accordance with Aspect 1 of the present invention comprises: a pick roller for picking out paper accommodated in a paper cassette; a separation roller for separating the paper picked out by the pick roller to feed the paper one sheet at a time; separation-roller driving means for moving the separation roller into contact with or away from the pick roller; a lifter for moving the paper accommodated in the paper cassette to cause the paper to abut against the pick roller; lifter driving means for driving the lifter; driving means for driving the separation-roller driving means and the lifter driving means; and control means for controlling the separation-roller driving means and the lifter driving means in such a manner as to cause the separation roller and the paper to abut against the pick roller when the paper is fed and to cause the separation roller and the paper to be disengaged from the pick roller when the paper is not fed.

In the automatic paper feeder in accordance with Aspect 2, a single driving means is used as the driving means for driving the separation-roller driving means and the lifter driving means, and the separation-roller driving means and the lifter driving means are interlocked.

In the automatic paper feeder in accordance with Aspect 3, the separation-roller driving means is constituted by a lever which is capable of rotating about an arbitrary point in a plane perpendicular to a plane in a traveling direction of the paper and parallel to the traveling direction of the paper, and a center of rotation of the lever is disposed on a straight line which passes a portion of contact between the pick roller and the separation roller and which is perpendicular to a straight line connecting a center of rotation of the pick roller and a center of rotation of the separation roller.

The automatic paper feeder in accordance with Aspect 4 further comprises: a paper-passage preventing member which is located in a vicinity of a portion of contact between the pick roller and the separation roller, and is arranged such that when the separation roller is at a position in which the separation roller abuts against the pick roller, the paper-passage preventing member is located below a paper separating portion, and when the separation roller is at a position in which the separation roller is retreated from the pick roller, the paper-passage preventing member is located above the separation roller and in a paper transporting passage.

The automatic paper feeder in accordance with Aspect 5 further comprises: paper pressing means for pressing the paper toward a lower surface of the paper cassette.

In the automatic paper feeder in accordance with Aspect 6, a plurality of paper pressing means are provided as the paper pressing means in such a manner as to be located in a vicinity of a paper picking portion and at an equal distance from a center of the paper cassette in an axial direction of the pick roller.

The automatic paper feeder in accordance with Aspect 7 further comprises: a feed roller opposing the pick roller downstream of the separation roller in a traveling direction of the paper and adapted to transport the paper separated by the separation roller, as the feed roller is brought into contact with the pick roller.

The automatic paper feeder in accordance with Aspect 8 further comprises: a pair of frictional members disposed on that downstream side, as viewed in the traveling direction of the paper, of the paper cassette which opposes the paper, substantially at positions corresponding to widthwise opposite ends of the paper.

In the automatic paper feeder in accordance with Aspect 9, the pair of frictional members are respectively provided on those sides of a pair of paper-width restricting plates disposed in the paper cassette which oppose the paper.

In the automatic paper feeder in accordance with Aspect 10, the pick roller is split into a plurality of rollers disposed on an identical rotating shaft at predetermined intervals and having identical radii, the separation roller being arranged to be capable of being moved into contact with or away from at least one of the split pick rollers, and the feed roller for transporting the paper separated by the separation roller being arranged to be capable of being moved, on a downstream side of the separation roller in the traveling direction of the paper, into contact with or away from at least one of the pick rollers other than the pick roller capable of being moved into contact with or away from the separation roller.

The automatic paper feeder in accordance with Aspect 11 further comprises: a paper guide disposed upstream of the separation roller in the traveling direction of the paper in such a manner as to cover front side surface portions, as viewed in the traveling direction of the paper, of the separation roller.

In the automatic paper feeder in accordance with Aspect 12, the paper guide is moved by being interlocked with the movement of the separation roller into contact with or away from the pick roller.

In the automatic paper feeder in accordance with Aspect 13, a surface of the paper guide is processed into an uneven surface.

In the automatic paper feeder in accordance with Aspect 14, the paper guide has a frictional member provided on a surface thereof.

In the automatic paper feeder in accordance with Aspect 15, the separation roller is provided with a vane wheel.

In the automatic paper feeder in accordance with Aspect 16, a surface of the separation roller is processed into an uneven surface.

In the automatic paper feeder in accordance with Aspect 17, the separation roller has a frictional member provided on a surface thereof.

In the automatic paper feeder in accordance with Aspect 18, a paper discharge passage for discharging the paper after the printing thereof is disposed on a side of the pick roller which is opposite to a side thereof for picking out the paper in the paper cassette, and there are provided a paper discharge roller disposed at a position for sandwiching the paper discharge passage with the pick roller and means for moving the paper discharge roller into contact with or away from the pick roller.

In the automatic paper feeder in accordance with Aspect 19, the control means has driving-amount varying means for making variable an amount of driving of the lifter driving means in correspondence with a kind of paper loaded in the paper cassette.

The automatic paper feeder in accordance with Aspect 20 further comprises: a feed roller for transporting the paper separated by the separation roller to a printing section; and a rotation-amount setting means for setting in advance an amount of rotation of the pick roller necessary for the pick roller to transport the paper in the paper cassette onto the feed roller, wherein the control means provides control such that when the amount of rotation of the pick roller has reached the set amount of rotation after the starting of the feeding of the paper by the pick roller, the separation-roller driving means is driven to retreat the separation roller, and the lifter driving means is driven to lower the lifter.

The automatic paper feeder in accordance with Aspect 21 further comprises: a feed roller for transporting the paper separated by the separation roller to a printing section; paper detecting means for detecting the paper on a downstream side of the feed roller in the traveling direction of the paper; and a rotation-amount setting means for setting in advance an amount of rotation of the pick roller necessary for transporting the paper to the paper detecting means, wherein the control means provides control such that if the paper detecting means does not detect the paper while the amount of rotation of the pick roller reaches the set amount of rotation after the starting of the feeding of the paper by the pick roller, the rotation of the pick roller is stopped, and after an amount of lifting by the lifter is increased, the pick roller is rotated again.

The automatic paper feeder in accordance with Aspect 22 further comprises: a feed roller for transporting the paper separated by the separation roller to a printing section; paper detecting means for detecting the paper on a downstream side of the feed roller in the traveling direction of the paper; and a rotation-amount setting means for setting in advance an amount of rotation of the pick roller necessary for transporting the paper to the paper detecting means, wherein the control means provides control such that if the paper detecting means does not detect the paper while the amount of rotation of the pick roller reaches the set amount of rotation after the starting of the feeding of the paper by the pick roller, the rotation of the pick roller is stopped, and after the pick roller is rotated in an opposite direction to the traveling direction of the paper by the set amount of rotation, the feeding of the paper is resumed.

The automatic paper feeder in accordance with Aspect 23 further comprises: overlapped-feed detecting means for detecting an overlapped feeding of the paper and disposed downstream of the separation roller in the traveling direction of the paper, wherein the control means provides control such that when the overlapped feeding of the paper has been detected by the overlapped-feed detecting means, the rotation of the pick roller and the separation roller is stopped, the lifter is lowered to return the paper in pressure contact with the pick roller to an original position thereof, and after the pick roller is rotated by a fixed amount in an opposite direction to the traveling direction of the paper, the feeding of the paper is resumed.

In the automatic paper feeder in accordance with Aspect 24, the control means provides control such that after the separation roller is made to abut against the pick roller by the separation-roller driving means, the pick roller is rotated in the traveling direction of the paper, and after the separation roller is sufficiently rotated by following the rotation of the pick roller, the paper in the paper cassette is made to abut against the pick roller by the lifter driving means.

DETAILED DESCRIPTION OF THE PREFERRED EMBODIMENTS

(First Embodiment)

Figure 1:
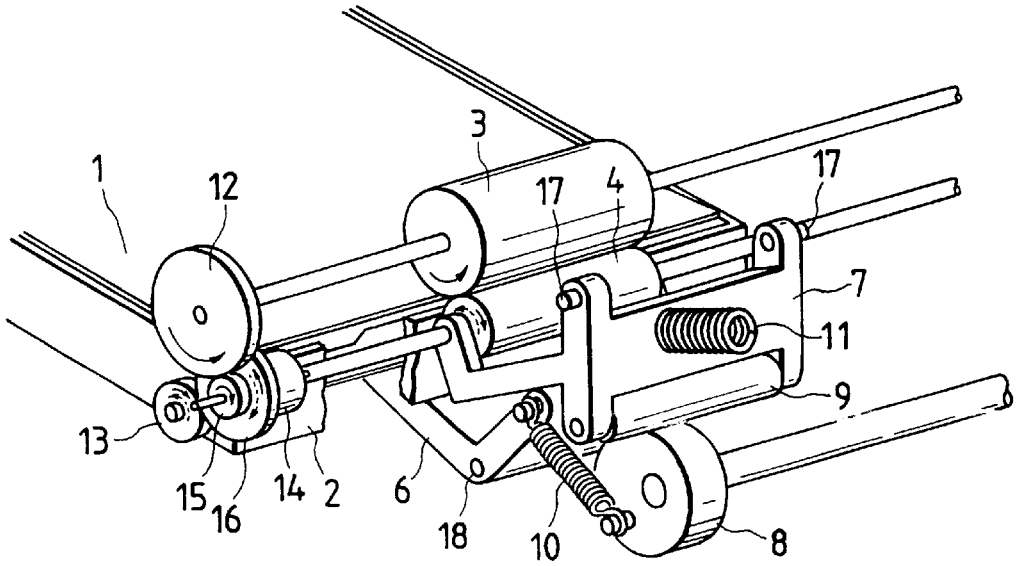
FIG. 1 is a perspective view of an automatic paper feeder in accordance with a first embodiment of the present invention.
Figure 2:
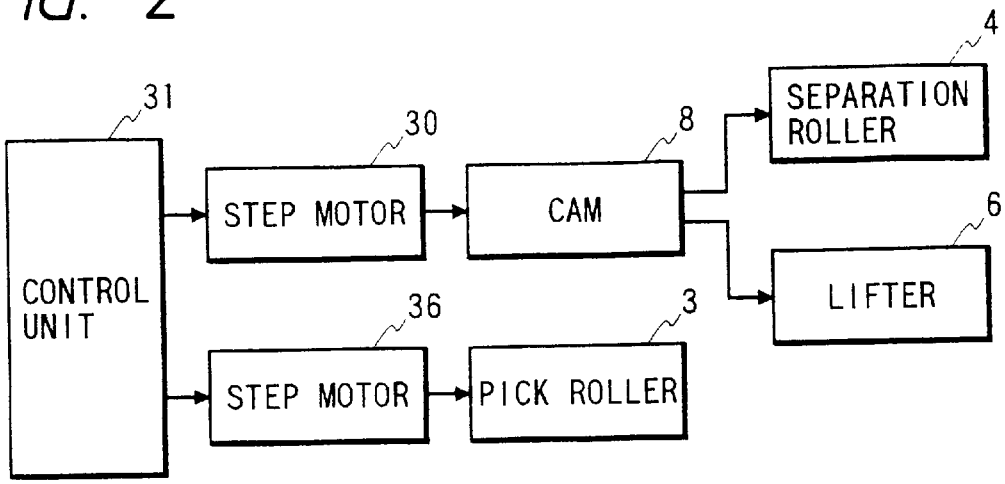
FIG. 2 is a block diagram of a control mechanism section in accordance with the first embodiment.

FIG. 1 is a perspective view illustrating a first embodiment of an automatic paper feeder in accordance with the present invention, and FIG. 2 is a block diagram of a control mechanism section thereof. In these drawings, reference numeral 1 denotes paper; 2, a paper cassette for accommodating the paper 1; 3, a pick roller driven by a step motor 36 to pick out the paper 1; 4, a separation roller for separating the sheets of paper 1 picked out from the paper cassette 2 by the pick roller 3; 6, a lifter for moving the paper 1 into contact with or away from the pick roller 3; and 7, a lever supporting the separation roller 4 and arranged to be rotatable about a shaft 17. The separation roller 4 is brought into pressure contact with the pick roller 3 by a spring 11 which is an urging means, and a contacting pressure is imparted to a separating portion 19, i.e., a portion of contact between the separation roller 4 and the pick roller 3.

Incidentally, the spring 11 has one end retained at a casing of the automatic paper feeder.

The lifter is connected to a cam 8 by means of a spring 10, and is arranged to be rotatable about a shaft 18 as the cam 8 rotates. The cam 8 is rotatively driven by a step motor 30, i.e., a driving source, and effects the position control of the lever 7 by means of a follower 9.

The driving force of the pick roller 3 is transmitted to a separation roller gear 13 by means of a pick roller gear 12, a gear 15, and a gear 16 so as to drive the separation roller 4. A torque limiter 14 is connected to the gear 15 and the gear 16. The arrangement provided is such that if a relative rotational torque between the gear 15 and the gear 16 is less than or equal to a set torque of the torque limiter 14, the gear 15 and the gear 16 rotate at the same phase, whereas if the relative rotational torque between the gear 15 and the gear 16 is greater than the set torque of the torque limiter 14, the gear 15 and the gear 16 rotate with opposite phases.

That is, in the state in which the separation roller 4 is held in a state of pressure contact with the pick roller 3 without the paper 1 placed therebetween, if the pick roller 3 is rotated in the traveling direction of the paper 1, the separation roller 4 rotates by following the pick roller 3, and the gears rotate in the directions of arrows indicated by solid lines in FIG. 1, respectively. When one sheet of paper 1 is present at the separating portion 19, the separation roller 4 rotates (in the direction of the arrow indicated by the solid line) by following the pick roller 3 with the paper 1 placed therebetween owing to the set torque of the torque limiter 14 and the contacting pressure imparted to the separating portion 19 by the spring 11, so that the paper 1 is fed in the traveling direction. When two or more sheets of paper 1 are present at the separating portion 19, the relative torque between the gears 15 and 16 exceeds the set torque of the torque limiter and the separation roller 4 is rotated in the direction of the arrow indicated by the broken line by the torque limiter 14. Accordingly, when two or more sheets of paper 1 have advanced into the separating portion 19, the separation roller 4 separates the sheets of paper 1, and transports only one sheet of paper 1 in the downstream direction.

Reference numeral 31 denotes a control unit for controlling the operation of the pick roller 3, the separation roller 4, the lifter 6, and the like.

Figure 3:
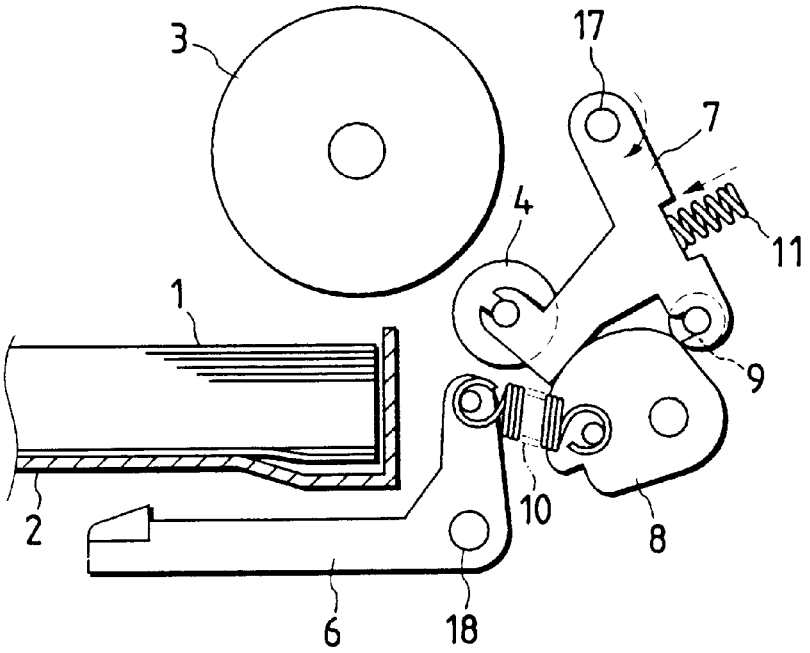
FIG. 3 is a side cross-sectional view illustrating an initial state of the paper feeding operation in accordance with the first embodiment.
Figure 4:
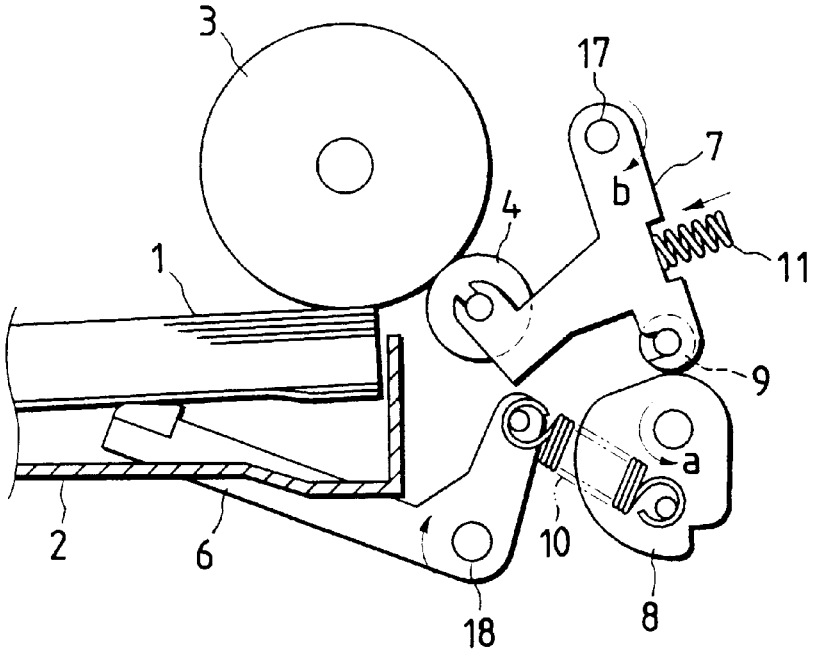
FIG. 4 is a side cross-sectional view illustrating a paper feeding state of the paper feeding operation in accordance with the first embodiment.

Next, a description will be given of the operation. FIGS. 3 and 4 are cross-sectional views illustrating the operation of the first embodiment of the automatic paper feeder in accordance with the present invention, in which FIG. 3 illustrates an initial state, and FIG. 4 illustrates a paper-feeding state.

As shown in FIG. 3, in the initial state, the spring 11 is in a compressed state, and the moment in the direction of the arrow acts about the shaft 17 due to a restoring force of the spring 11 having one end retained at the casing of the automatic paper feeder. Hence, a force is exerted for causing the separation roller 4 attached to the lever 7 to rotate about the shaft 17 in the direction of the arrow indicated by the broken line. However, the position of the lever 7 is restricted by the cam 8 by means of the follower 9, so that the separation roller 4 is held at a position spaced apart from the pick roller 3.

As shown in FIG. 4, in the paper-feeding state, as the cam 8 is rotated a fixed angle in the direction of arrow a by means of the step motor 30, the restriction of the position of the lever 7 is canceled by means of the follower 9. The lever 7, whose positional restriction is canceled, rotates about the shaft 17 in the direction of arrow b by means of the restoring force of the spring 11, and causes the separation roller 4 supported by the lever 7 to abut against the pick roller 3. In addition, if the cam 8 is rotated in the direction of arrow a, the lifter 6, which is connected to the cam 8 by means of the spring 10, rotates about the shaft 18 and pushes upward the paper 1 in the paper cassette 2 so as to cause the paper 1 to come into pressure contact with the pick roller 3, thereby producing a contacting pressure for paper feed. As the pick roller 3 is driven by the step motor 36, the paper 1 is taken out from inside the paper cassette 2.

After completion of the paper feeding, the step motor 30 is rotated reversely to rotate the cam 8 in the opposite direction to the direction of the arrow a shown in FIG. 4, which in turn returns the lifter 6 to the initial position shown in FIG. 2 to return the paper 1 held in pressure contact with the pick roller 3 back into the paper cassette 2. In addition, the position of the lever 7 is restricted by the cam 8 via the follower 9, so that the lever 7 is returned to the initial position shown in FIG. 3, and the separation roller 4 is spaced apart from the pick roller 3. The two operations, i.e., the operation of moving the separation roller 4 into contact with and away from the pick roller 3 and the operation of driving the lifter 6, can thus be effected by the single operation of driving the cam 8.

(Second Embodiment)

Figure 5:
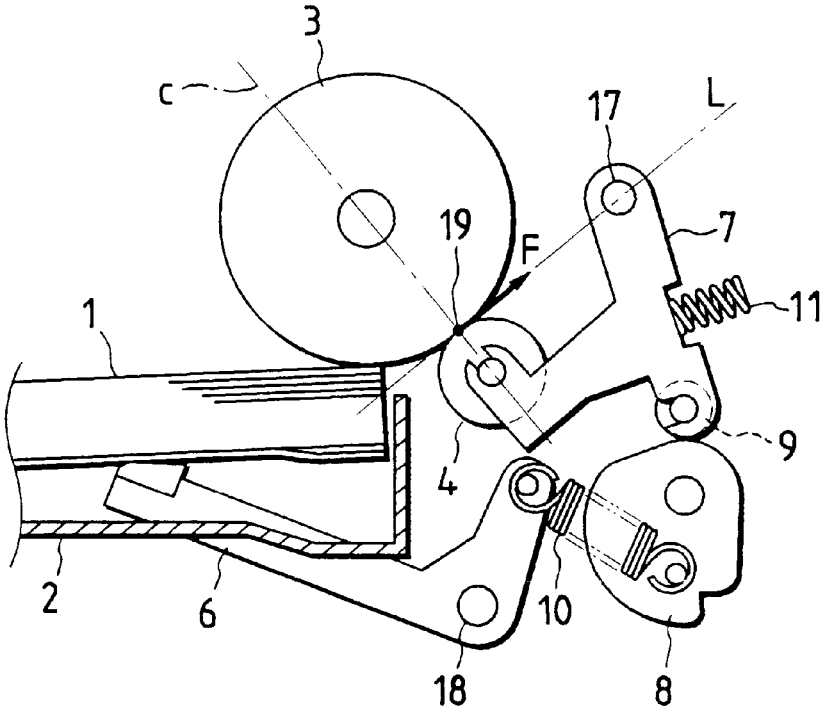
FIG. 5 is a side cross-sectional view illustrating an arrangement of the automatic paper feeder in accordance with a second embodiment of the present invention.

FIG. 5 is a sectional side elevation illustrating a second embodiment of the automatic paper feeder in accordance with the present invention. As shown in FIG. 5, the central axis 17 of rotation of the lever 7 is disposed on a line L which is perpendicular to a straight line c connecting the central axis of the pick roller 3 and the central axis of the separation roller 4 and which passes through the separating portion 19. Reference character F denotes a tangential force which is derived from the paper-transporting force or the paper-separating force, which occurs at the time of transporting or separating the paper 1. Since the other components and the arrangement thereof are similar to those of the first embodiment, a description thereof will be omitted here.

In accordance with the above-described second embodiment, the aforementioned tangential force F is always directed toward the shaft 17, i.e., the central axis of rotation of the separation roller 4, so that a moment about the shaft 17 due to the tangential force F is avoided. Hence, it is possible to eliminate the effect of abutment of the separation roller 4 against the pick roller 3 on the contacting pressure occurring in the separating portion.

(Third Embodiment)

Figure 6:
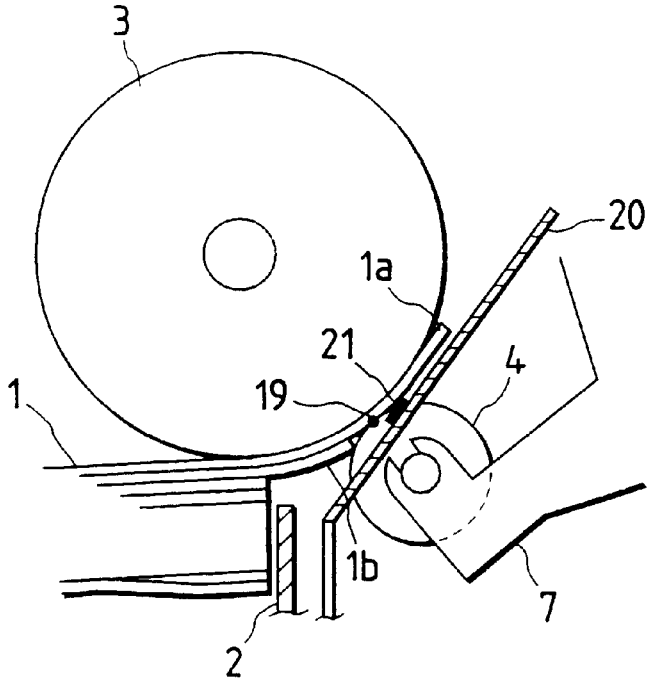
FIG. 6 is an enlarged side cross-sectional view of the automatic paper feeder in accordance with a third embodiment of the present invention.
Figure 7:
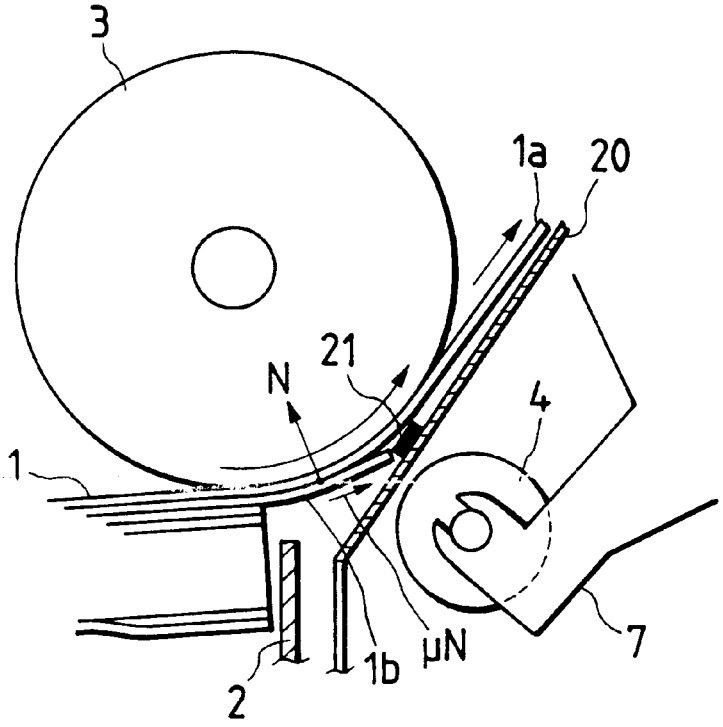
FIG. 7 is a state diagram illustrating the paper feeding operation in accordance with the third embodiment.
Figure 8:
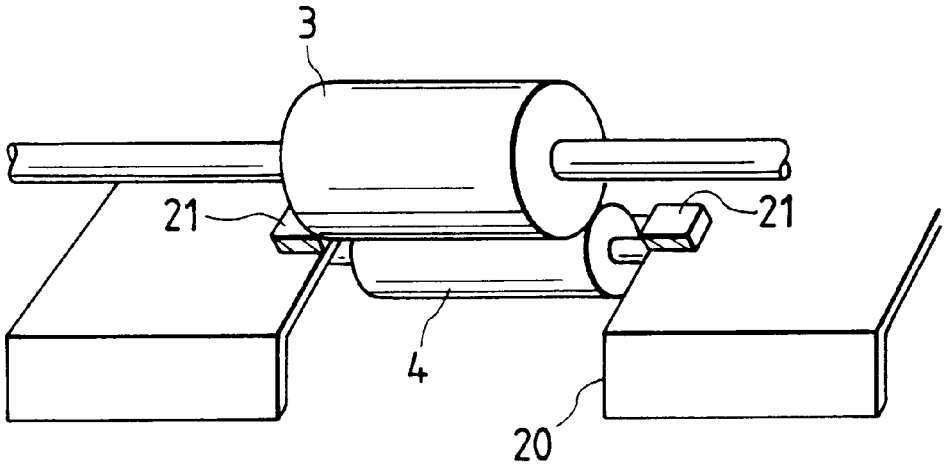
FIG. 8 is a perspective view in accordance with the third embodiment.

FIGS. 6 and 7 are enlarged sectional side elevations illustrating a third embodiment of the automatic paper feeder in accordance with the present invention. FIG. 8 is a perspective view of an essential portion thereof. As shown in the drawings, a paper guide 20, which is fixed to the casing of the automatic paper feeder, is provided in such a manner as to extend along both sides of the separation roller 4, and a pair of projections 21 are respectively provided on both sides of guide 20. The projections 21 are disposed in the vicinities of the separating portion 19, i.e., the portion of contact between the pick roller 3 and the separation roller 4, and at positions which do not interfere with the pick roller 3 and the separation roller 4. The height of each projection 21 is set so as not to be higher than the separating portion 19. Since the other components and the arrangement thereof are similar to those of the first embodiment, a description thereof will be omitted here.

Next, a description will be given of the operation of the third embodiment. FIG. 6 illustrates a case where two sheets of paper 1 have advanced into the separating portion 19 in the state in which the separation roller 4 abuts against the pick roller 3. In the drawing, since the projections 21 are disposed on the side below the separating portion 19, an upper sheet 1*a* of the two sheets of paper 1 passes the separating portion 19 without interfering with the projections 21, and is transported to the ensuing step. A lower sheet 1*b* is separated from the upper sheet 1*a* by the separation roller 4 at the separating portion 19, and its leading end does not return to the interior of the paper cassette 2, and remains on standby in the vicinity of the separating portion 19.

FIG. 7 illustrates a state in which after the passing of the upper sheet of paper 1 through the separating portion 19, the separation roller 4 retreated away from the pick roller 3 and returned to its initial position. In the illustrated state, the sheet 1*a* is in the course of being transported to the ensuing step, a drag N is produced between the sheets 1*a* and 1*b* due to the reaction force or the like based on the weight of the sheet 1*a* itself and the restoring force of the deflected sheet 1*b* itself, and a transporting force $\mu$N is produced in the sheet 1*b* due to a coefficient of friction $\mu$ between the sheets 1*a* and 1*b*. Hence, the sheet 1*b* tends to advance in the traveling direction along the paper guide 20 due to the transporting force $\mu$N in such a manner as to accompany the sheet 1*a*. At this time, because the separation roller 4 is retreated away from the pick roller 3, the projections 21 are located above the separation roller 4 and on the surface of the paper guide 20, i.e., the transport passage of the paper 1, so as to interfere with the paper 1*b*.

In accordance with the above-described third embodiment, the arrangement provided is such that the projections 21 are provided on the paper guide 20 serving as the paper transporting passage after the retreat of the separation roller 4 away from the pick roller 3, the projections 21 are located below the separating portion 19 serving as the paper transporting passage in the case where the separation roller 4 abuts against the pick roller 3, such that when the separation roller 4 is retreated away from the pick roller 3, the projections 21 are located above the separation roller 4 and in the paper transporting passage. As such, when the separation roller 4 is retreated away from the pick roller 3, the second sheet of paper 1*a* is stopped by the projections 21, making it possible to prevent an extra sheet of paper 1 from being fed. Hence, it is possible to prevent an overlapped feeding and a misfeeding. The present invention need not be limited to projections as shown, and members which are equivalent to the projections 21 may be attached to the paper guide 20.

(Fourth Embodiment)

Figure 9:
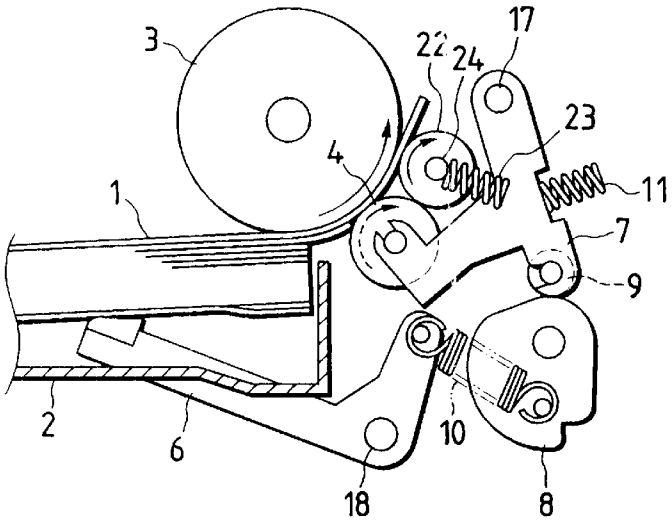
FIG. 9 is a side cross-sectional view illustrating the automatic paper feeder in accordance with a fourth embodiment of the present invention.

FIG. 9 is a side cross-sectional view illustrating a fourth embodiment of the automatic paper feeder in accordance with the present invention. As shown in the drawing, a feed roller 22 for transporting the paper 1, which has been separated at the separating section 19, to the ensuing step is arranged to be brought into contact with the pick roller 3 by a spring 23, i.e., an urging means, on the downstream side of the separation roller 4 in the traveling direction of the paper 1 in such a manner as not to interfere with the separation roller 4. The feed roller 22 is rotatable about its feed roller shaft 24, does not itself have a driving force, and is adapted to be rotated by following the rotation of the pick roller 3. Since the other arrangements are similar to those of the first embodiment, a description thereof will be omitted here.

In accordance with the above-described fourth embodiment, since the arrangement provided is such that the feed roller 22 is made to abut against the pick roller 3 and is rotated by following the rotation of the pick roller 3, the feed roller 22 does not require its own driving force, so that a reduction in cost can be expected.

(Fifth Embodiment)

Figure 10A:
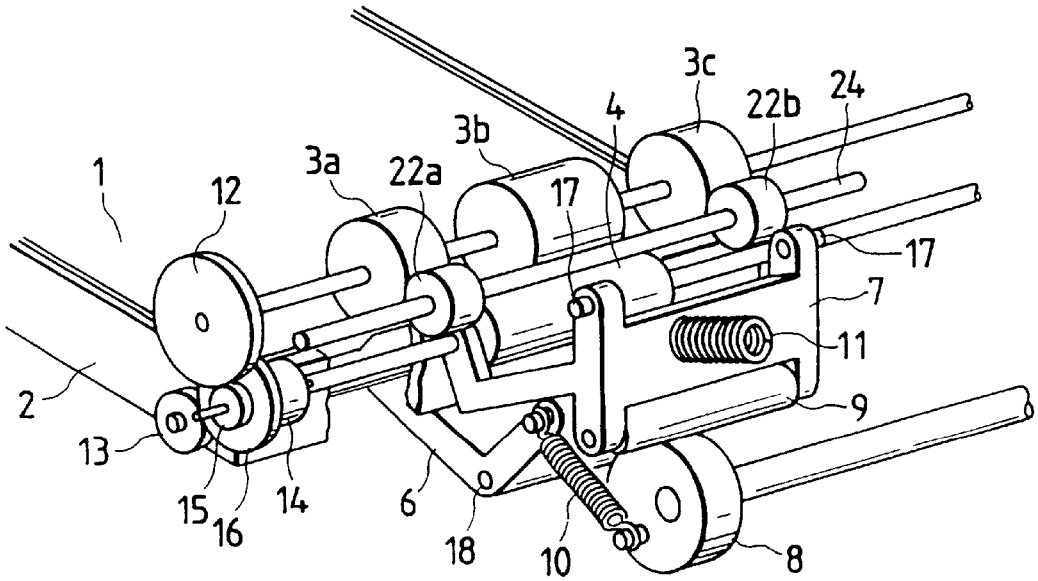
FIGS. 10A and 10B are schematic diagrams of the automatic paper feeder in accordance with a fifth embodiment of the present invention.
Figure 10B:
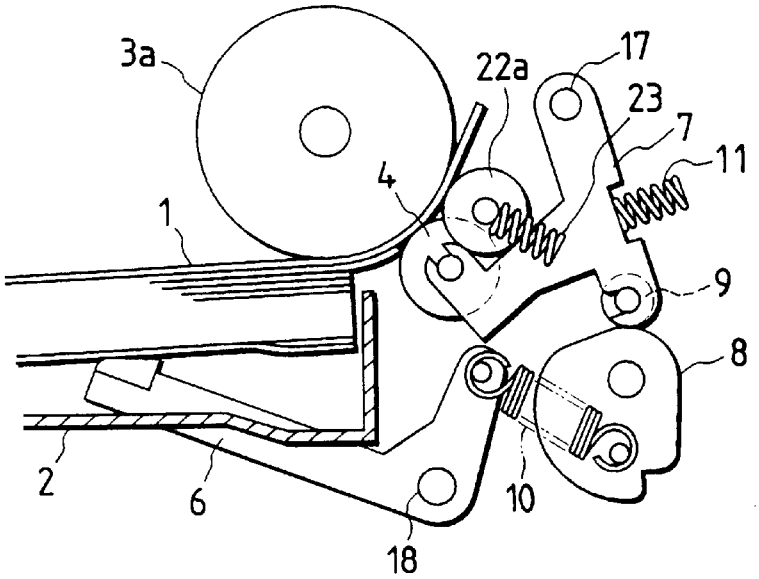

FIG. 10A is a perspective view illustrating a fifth embodiment of the automatic paper feeder in accordance with the present invention, and FIG. 10B is a side cross-sectional view thereof. As shown in the drawings, the arrangement provided is such that the separation roller 4 is positioned to abut against the middle pick roller 3*b* of three split pick rollers 3*a*, 3*b*, and 3*c*, and two split feed rollers 22*a* and 22*b* on the downstream side of the separating portion 19 in the traveling direction of the paper 1 are made to abut against the pick rollers 3*a* and 3*c*. Since the other components and the arrangement thereof are similar to those of the first embodiment, a description thereof will be omitted here.

In the above-described fourth embodiment (FIG. 9), the separation roller 4 and the feed roller 22 are urged against the same pick roller 3. Therefore, in order to ensure that the separation roller 4 and the feed roller 22 do not interfere with each other, it is necessary to dispose the feed roller 22 away from the separation roller 4 on the downstream side of the separating portion 19 in the traveling direction of the paper 1. Consequently, the paper transporting passage is raised up high. In accordance with the above-described fifth embodiment, since the separation roller 4 and the feed rollers 22*a* and 22*b* are arranged to abut against the separate pick rollers 3*b*, 3*a*, and 3*c*, respectively the feed rollers 22*a* and 22*b* can be disposed in proximity to the separation roller 4 as long as the feed roller shaft 24 does not interfere with the separation roller 4. Thus, it is possible to lower the paper transporting passage as compared with the fourth embodiment.

(Sixth Embodiment)

Figure 11:
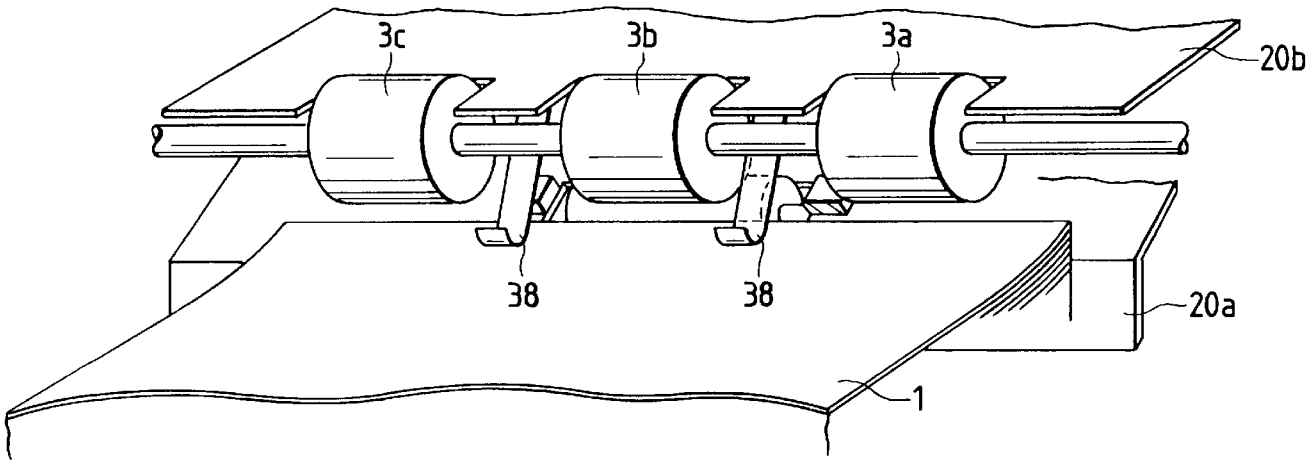
FIG. 11 is a perspective view of an essential portion of the automatic paper feeder in accordance with a sixth embodiment of the present invention.

FIG. 11 is a perspective view illustrating a sixth embodiment of the automatic paper feeder in accordance with the present invention, and is an enlarged perspective view of an essential portion as seen from the opposite direction of the view in FIG. 10A. In this drawing, reference numeral 20*a* denotes a paper guide provided on the lower side of the passage for transporting the paper 1; and 20*b* denotes a document guide provided on the upper side of the passage for transporting the paper 1 and fixed to an unillustrated casing or the like of the apparatus. Numeral 38 denotes a pressing tongue formed of a resilient member serving as a paper pressing means and fixed to the document guide 20*b*. In this embodiment, two pressing tongues 38 are provided at positions equidistant from the transverse center of the paper 1 and urge the paper 1 downward by means of their resiliency. Since the other components and the arrangement thereof are similar to those of the above-described fifth embodiment, a description thereof will be omitted here.

Figure 12:
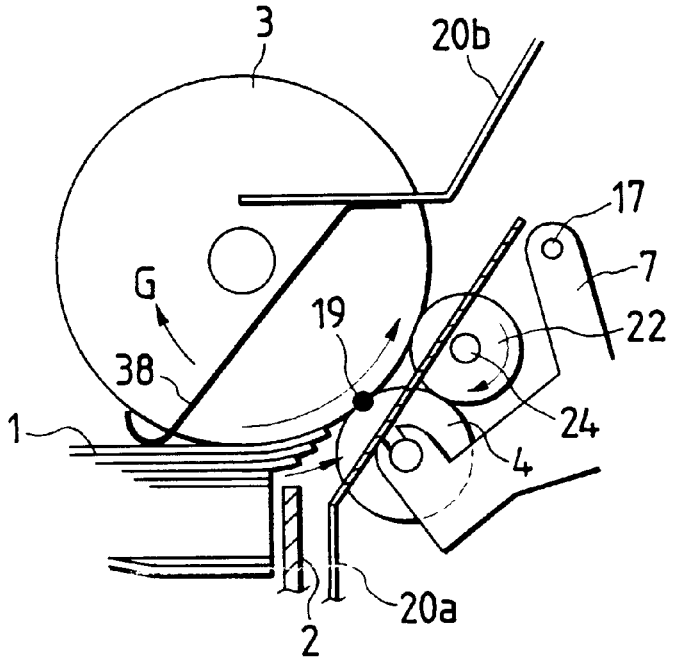
FIG. 12 is a side cross-sectional view of an essential portion illustrating the initial state of the paper separating operation in accordance with the sixth embodiment.
Figure 13:
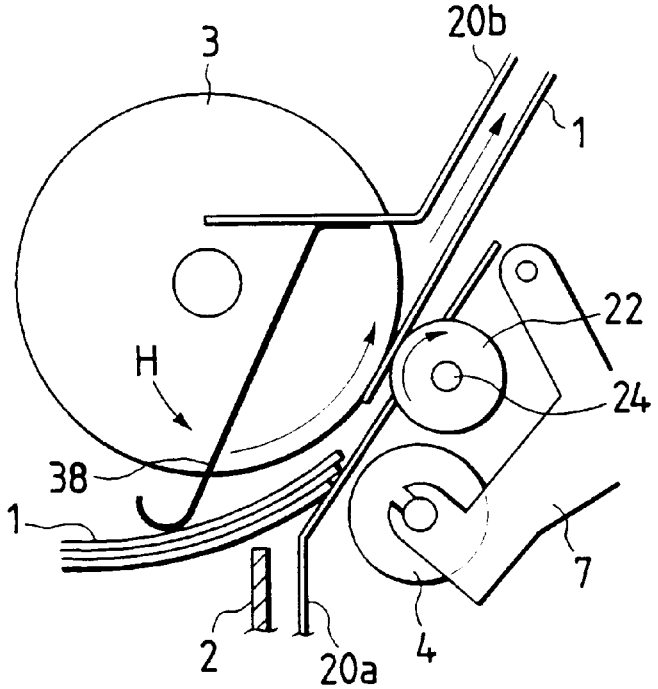
FIG. 13 is a side cross-sectional view of an essential portion illustrating the paper separating operation in accordance with the sixth embodiment.

In this sixth embodiment, since the pressing tongues 38 formed of resilient members are provided at a predetermined interval on the document guide 20*b* disposed on the upper side of the passage for transporting the paper 1, the initial state in the paper separating operation is shown in FIG. 12. That is, as the paper 1 in the paper cassette 2 is raised by the lifter 6, the upper surface of the paper 1 is brought into contact with the pick rollers 3*a*, 3*b*, and 3*c*, and is also brought into contact with the pressing tongues 38. Since the pressing tongues 38 are formed of the resilient members, distal ends of the pressing tongues 38 are deformed in the direction of arrow G shown in FIG. 12.

In a case where a plurality of sheets of paper 1 have entered the separating portion 19 for separating the paper 1 and have been separated to pass only one sheet, the leading ends of the sheets of paper 1 that have been pushed back toward the paper cassette 2 by the separation roller 4 are located immediately before the separating portion 19 on the upstream side in the traveling direction of the paper. After the operation of separating the paper 1, the separation roller 4 moves away from the pick roller 3*b* so that the pressing tongues 38 which have been deformed return and restore their shapes in the direction of arrow H, pushing down the pushed-back sheets of paper 1 toward the paper guide 20*a*. Accordingly, since the upper surface of the pushed-back paper 1 is held away from the pick roller 3, it is possible to prevent overlapped feeding from occurring when, after the trailing end of a single separated sheet of paper 1 has passed the separating portion 19, an ensuing sheet of paper 1 follows the same and enters the portion of contact between the pick roller 3 and the feed roller 22.

Although in the above-described sixth embodiment the pressing tongue 38 is a leaf spring formed of a resilient material, the pressing tongue 38 may be formed of the resilient material, and a roller (not shown) may be attached to that portion of the pressing tongue which comes into contact with the paper 1 in the paper cassette 2. In this arrangement as well, a similar effect can be obtained, and it is possible to obtain the effect of preventing damage to the paper 1.

In addition, the paper pressing means may not be plural, and one paper pressing means is capable of preventing the occurrence of the overlapped feeding.

(Seventh Embodiment)

Figure 14:
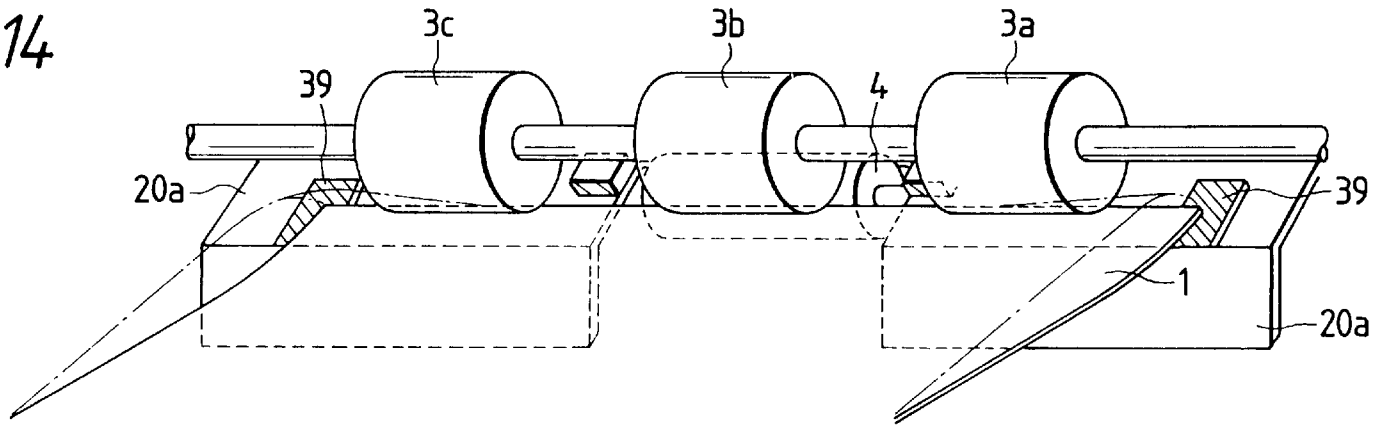
FIG. 14 is a perspective view of an essential portion of the automatic paper feeder in accordance with a seventh embodiment of the present invention.

FIG. 14 is a perspective view of an essential portion illustrating a seventh embodiment of the automatic paper feeder in accordance with the present invention. FIGS. 15, 16, 17, and 18 are side cross-sectional views of the essential portion illustrating the paper feeding and separating operation. In the drawings, reference numeral 39 denotes a friction pad serving as a frictional member. In this embodiment, two friction pads 39 are provided on the upper surface of the paper guide 20*a* disposed on the lower side of the passage for transporting the paper 1, at positions corresponding to widthwise opposite ends of the paper 1. Since the other components and the arrangement thereof are similar to those of the above-described sixth embodiment, a description thereof will be omitted here.

Figure 15:
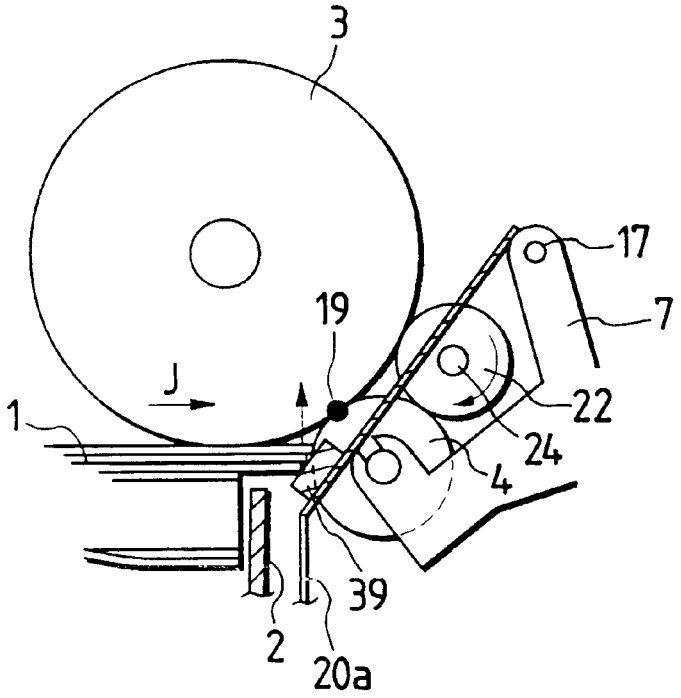
FIG. 15 is a side cross-sectional view of the essential portion illustrating the initial state of the paper feeding operation in accordance with the seventh embodiment.
Figure 16:
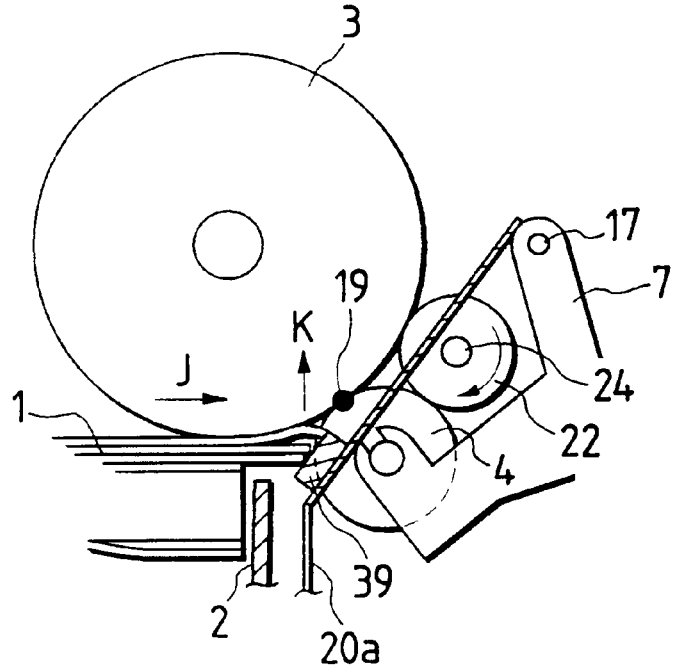
FIG. 16 is a side cross-sectional view of the essential portion illustrating the paper feeding operation in accordance with the seventh embodiment.
Figure 17:
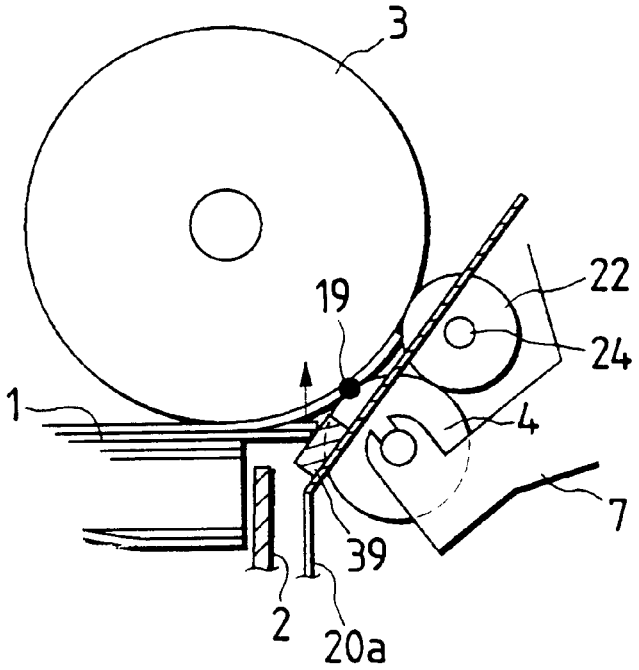
FIG. 17 is a side cross-sectional view of the essential portion illustrating the paper feeding operation in accordance with the seventh embodiment.
Figure 18:
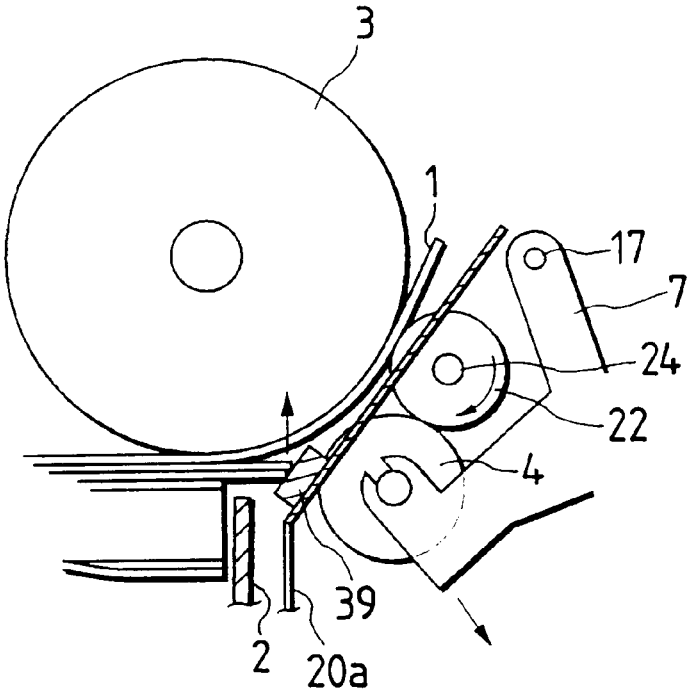
FIG. 18 is a side cross-sectional view of the essential portion illustrating the paper feeding operation in accordance with the seventh embodiment.

Next, a description will be given of only the operation of the essential portion. In a case where two or more sheets of paper 1 have been taken out from inside the paper cassette 2, as shown in FIG. 15, the leading ends of the sheets of paper 1 are brought into contact with the friction pads 39, so that their movement is restricted. The uppermost sheet of paper 1 is further transported in the illustrated direction of arrow J due to the pressure of contact between the paper 1 and the pick roller 3 produced by the lifter 6 as well as the rotation of the pick roller 3. Accordingly, as the opposite edges of the uppermost sheet of paper 1 are popped from the friction pads 39 in the direction of arrow K as shown in FIG. 16, the uppermost sheet of paper 1 is separated as one sheet, and enters the paper separating portion 19, as shown in FIG. 17. Subsequently, as shown in FIG. 18, the separation roller 4 and the lifter 6 return to the initial state, and the separated paper 1 is transported to the unillustrated ensuing step by the pick roller 3 and the feed roller 22. The sheets of paper 1 with their leading ends restricted by the friction pads 39 drop into the paper cassette 2 as the lifter 6 is lowered, thereby preventing the occurrence of an overlapped feeding. As described above, as the friction pads 39 are provided at the widthwise opposite ends of the paper 1 on the paper guide 20*a* disposed on the lower side of the passage for transporting the paper 1, it is possible to obtain the effect of prior separation on the upstream side of the separating portion 19 in the transporting direction.

(Eighth Embodiment)

Figure 19:
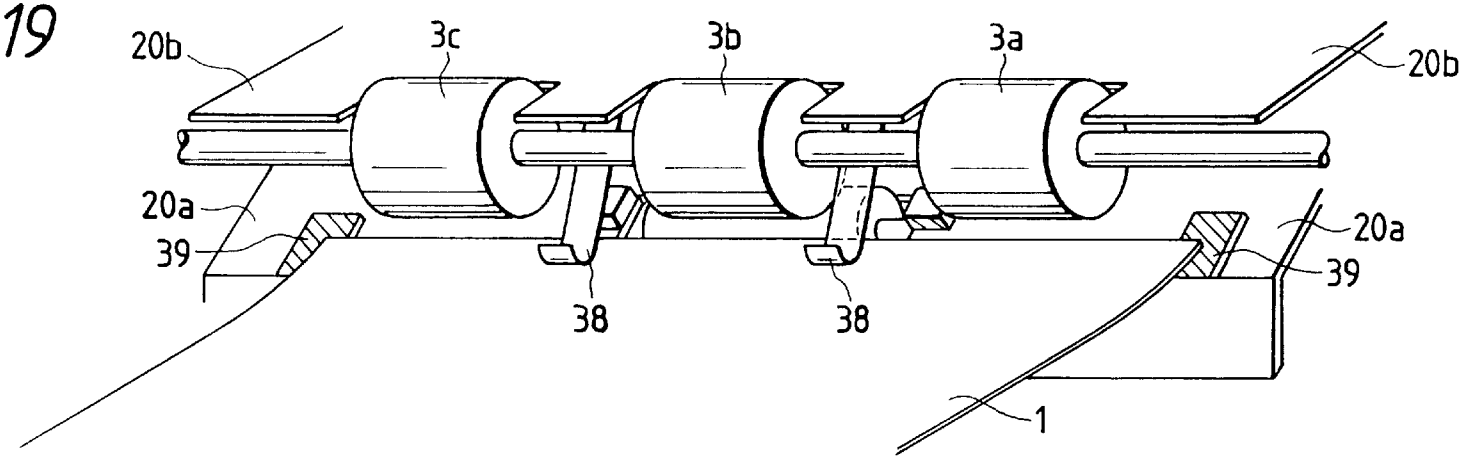
FIG. 19 is a perspective view of an essential portion of the automatic paper feeder in accordance with an eighth embodiment of the present invention.

Although in the above-described seventh embodiment an example has been shown in which the pressing tongues 38 of the sixth embodiment are not provided, it is possible to provide both the pressing tongues 38 and the friction pads 39 as shown in FIG. 19. In this case, it is possible to further improve the effect of separating the paper 1.

(Ninth Embodiment)

Figure 20:
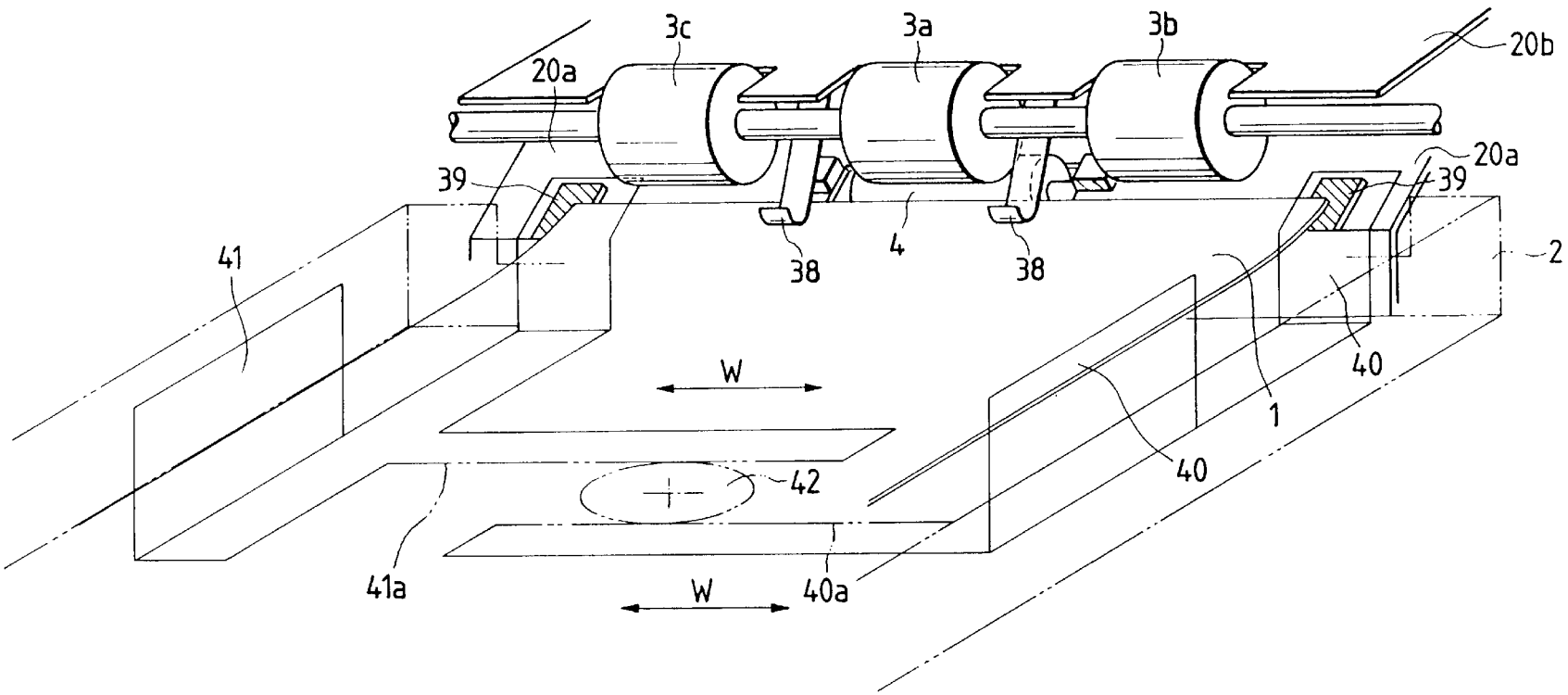
FIG. 20 is a perspective view of an essential portion of the automatic paper feeder in accordance with a ninth embodiment of the present invention.

FIG. 20 is a perspective view of an essential portion illustrating a ninth embodiment of the automatic paper feeder in accordance with the present invention. In the drawing, reference numerals 40 and 41 denote paper-width restricting plates provided in the paper cassette 2 and supported in such a manner as to be capable of moving together and apart as illustrated by arrows W. Numeral 42 denotes a gear which is rotatably supported in the paper cassette 2, and meshes with rack teeth portions 40*a* and 41*a* formed in portions of the paper-width restricting plates 40 and 41, respectively. Numeral 39 denotes the friction pad. Two friction pads 39 are respectively disposed on the paper-width restricting plates 40 sand 41. Since the other components and the arrangement thereof are similar to those of the above-described sixth and seventh embodiments, a description thereof will be omitted here.

Next, a description will be given of the operation. Since the operation concerning the feeding and separation of the paper 1 is similar to that in the above-described third embodiment, a description thereof will be omitted here. Since the paper-width restricting plates 40 and 41 are connected to each other by the gear 42, the paper-width restricting plate 40 and the paper-width restricting plate 41 move in mutually opposite directions. After the paper 1 is accommodated in the paper cassette 2, if the paper-width restricting plates 40 and 41 are moved in correspondence with the width of the paper 1, the friction pads 39 disposed on the paper-width restricting plates 40 and 41 are always located in the vicinities of the opposite edges of the paper 1. Thus, it is possible to obtain the effect of prior separation on the upstream side of the paper separating portion 19 in the transporting direction irrespective of the size of the paper 1 accommodated in the paper cassette 2.

(10th Embodiment)

Figure 21A:
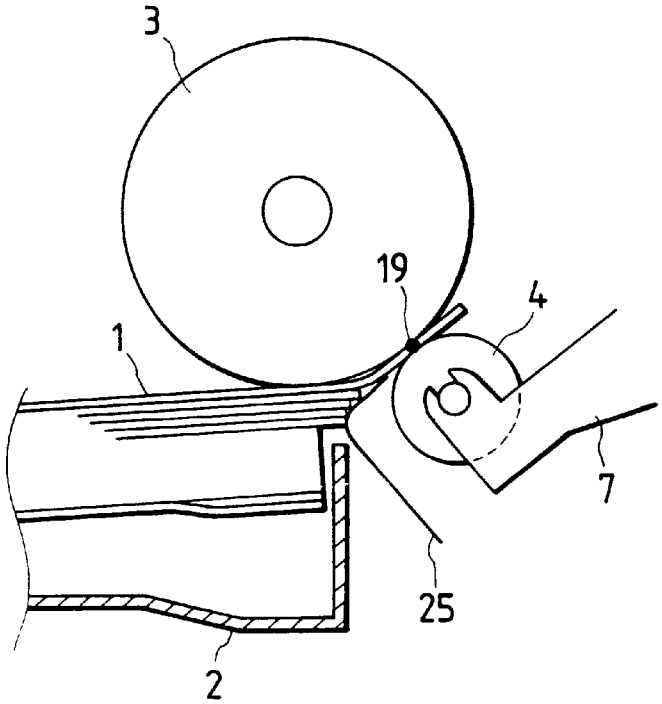
FIGS. 21A and 21B are enlarged side cross-sectional views of the automatic paper feeder in accordance with a 10th embodiment of the present invention.
Figure 21B:
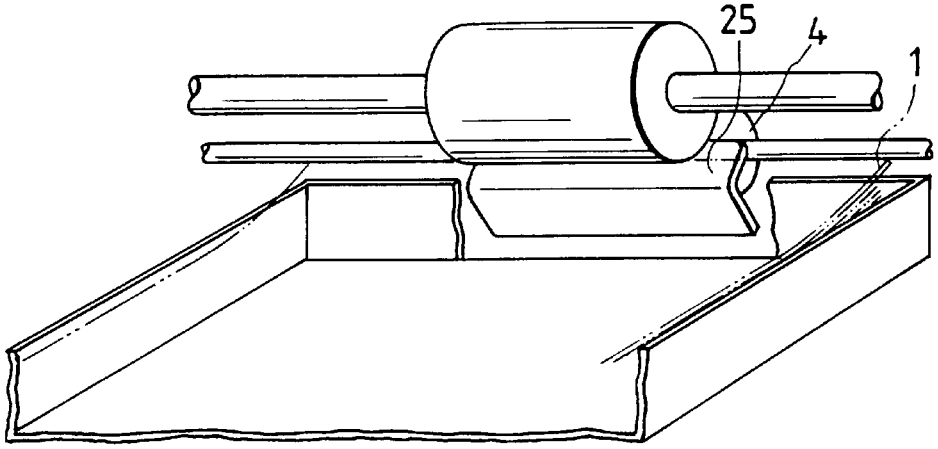

FIG. 21A is a partial enlarged view of a side cross section illustrating a 10th embodiment of the automatic paper feeder in accordance with the present invention, and FIG. 21B is a perspective view thereof. In the drawings, reference numeral 25 denotes a separation roller guide arranged in such a manner as to cover a front portion, as viewed in the traveling direction of the paper 1, of the separation roller 4. The separation roller 4 is shown abutting against the pick roller 3. Since the other components and the arrangement thereof are similar to those of the first embodiment, a description thereof will be omitted here.

The paper 1 picked out from inside the paper cassette 2 by the pick roller 3 is made to abut against the separation roller guide 25, and is then sent to the separating portion 19.

In accordance with the above-described 10th embodiment, the paper 1 is made to abut against the separation roller guide 25, so that the angle of the paper 1 entering the separating portion 19 can be varied by means of the angle of abutment, allowing smooth transport of the paper 1 into the separating portion 19. In addition, in a case where a plurality of sheets of paper 1 have been picked out by the pick roller 3, the sheets of paper 1 abutting against a lower portion of the separation roller guide 25 are stopped by the separation roller guide 25. Hence, it is possible to reduce the number of sheets entering the separating portion 19.

(11th Embodiment)

Figure 22:
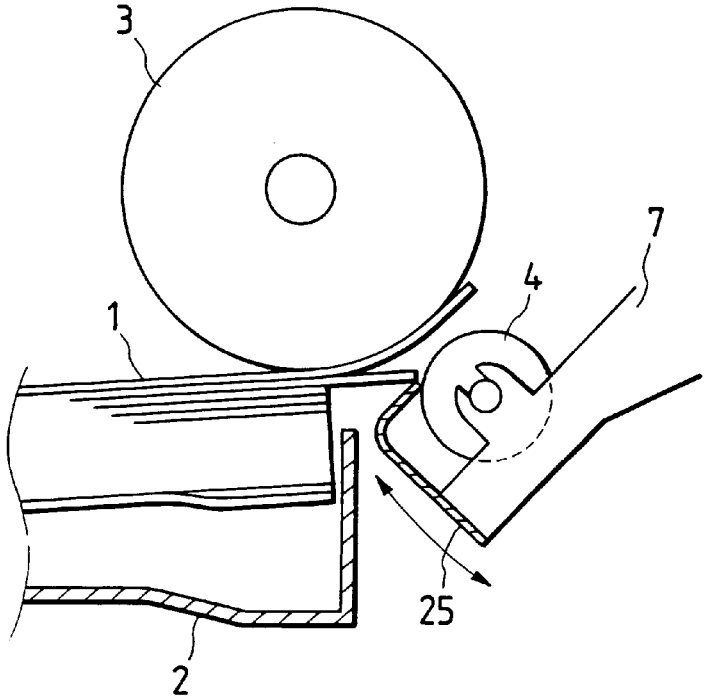
FIG. 22 is a side cross-sectional view of the automatic paper feeder in accordance with an 11th embodiment of the present invention.

FIG. 22 is a side cross-sectional view illustrating an 11th embodiment of the automatic paper feeder in accordance with the present invention. As shown in the drawing, the separation roller guide 25 is attached to the lever 7 which supports the separation roller 4, and is therefore arranged to be interlinked with the motion of the separation roller 4 moving into contact with or away from the pick roller 3. Since the other components and the arrangement thereof are similar to those of the first embodiment, a description thereof will be omitted here.

In the above-described 10th embodiment, there is a possibility that the paper 1 separated by the separation roller 4 fails to return to inside the paper cassette 2 and is caught by the separation roller guide 25, with the result that if the paper 1 thus caught comes into contact with the pick roller 3, an overlapped feeding or a misfeeding can possibly occur. Therefore, in accordance with the above-described 13th embodiment, the separation roller guide 25 is arranged to be interlinked with the motion of the separation roller 4 moving into contact with or away from the pick roller 3, whereby even if the separated paper 1 is caught by the separation roller guide 25, the thus-caught paper 1 can be separated from the pick roller 3 by retreating the separation roller guide 25 away from the pick roller 3.

(12th Embodiment)

Figure 23:
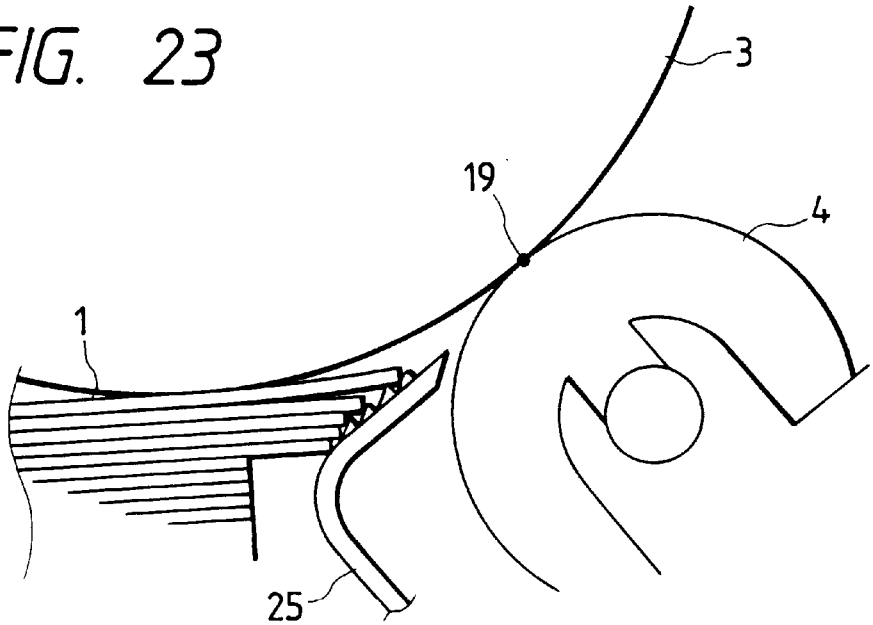
FIG. 23 is an enlarged side cross-sectional view of the automatic paper feeder in accordance with a 12th embodiment of the present invention.

FIG. 23 is a partial enlarged view of a side cross section illustrating a 12th embodiment of the automatic paper feeder in accordance with the present invention. The arrangement provided is such that the surface of the separation roller guide 25 is processed into an uneven surface so as to increase the frictional resistance between the paper 1 and the surface of the separation roller guide 25 when the paper 1 abuts against it. Since the other components and the arrangement thereof are similar to those of the 11th embodiment, a description thereof will be omitted here.

In accordance with the above-described 12th embodiment, since the arrangement is provided such that the frictional resistance at the time when the paper 1 abuts against the separation roller guide 25 increases, it is possible to enhance the prior separation effect before the paper 1 is separated by the separation roller 4 at the separating portion 19.

(13th Embodiment)

Figure 24:
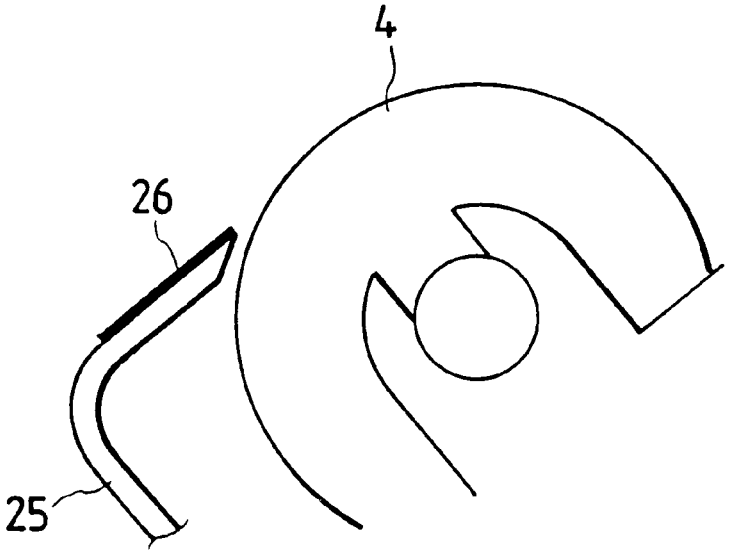
FIG. 24 is an enlarged side cross-sectional view of a paper guide in accordance with a 13th embodiment of the present invention.

Although in the above-described 12th embodiment the surface of the separation roller guide 25 is processed into an uneven surface, the present invention need not be restricted to the same. What is important is to enhance the prior separation effect before the paper 1 is transported to the separating portion 19, and an arrangement may be provided such that a frictional member 26 is attached to the separation roller guide 25, as shown in FIG. 24.

(14th Embodiment)

Figure 25:
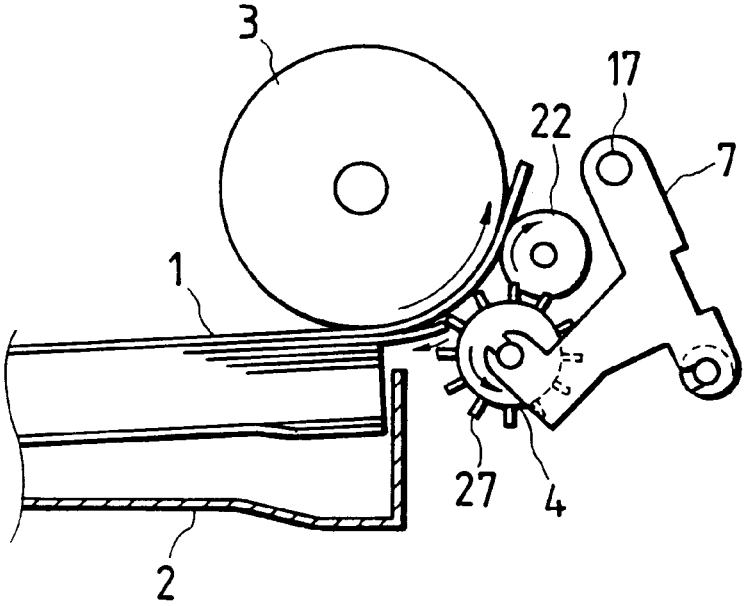
FIG. 25 is a side cross-sectional view of the automatic paper feeder in accordance with a 14th embodiment of the present invention.

FIG. 25 is a side cross-sectional view illustrating a 14th embodiment of the automatic paper feeder in accordance with the present invention. The arrangement provided is such that the separation roller 4 is provided with a vane wheel 27 so that the separation roller 4 and the vane wheel 27 rotate synchronously. Since the other components and the arrangement thereof are similar to those of the first embodiment, a description thereof will be omitted here.

In accordance with the above-described 14th embodiment, since the separation roller 4 is provided with the vane wheel 27, even if the paper 1 separated by the separation roller 4 fails to return to inside the paper cassette 2 and is stopped in the vicinity of the separating portion 19, it is possible to enhance the effect of returning the separated paper 1 to inside the paper cassette 2.

(15th Embodiment)

Figure 26:
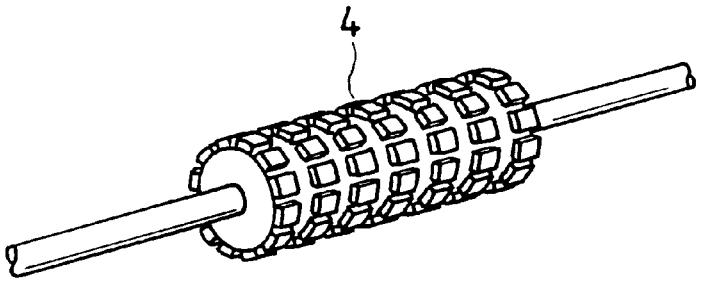
FIG. 26 is a perspective view of a separation roller in accordance with a 15th embodiment of the present invention.

FIG. 26 is a perspective view of the separation roller 4 illustrating a 15th embodiment of the automatic paper feeder in accordance with the present invention. In this 17th embodiment, the surface of the separation roller 4 is formed into an uneven surface. Since the other components and the arrangement thereof are similar to those of the first embodiment, a description thereof will be omitted here.

In accordance with the above-described embodiment, since the surface of the separation roller 4 is formed into the uneven surface, it is possible to increase the resistance of contact with the paper 1. In addition, it is possible to reduce paper dust from the paper 1 attached to the surface of the separation roller 4 and prevent the deterioration of the surface of the separation roller 4.

In addition, if a frictional member is merely provided on the surface of the separation roller 4, it is possible to enhance the resistance of contact with the paper 1 and obtain an auxiliary effect during the separation of the paper 1.

(16th Embodiment)

Figure 27:
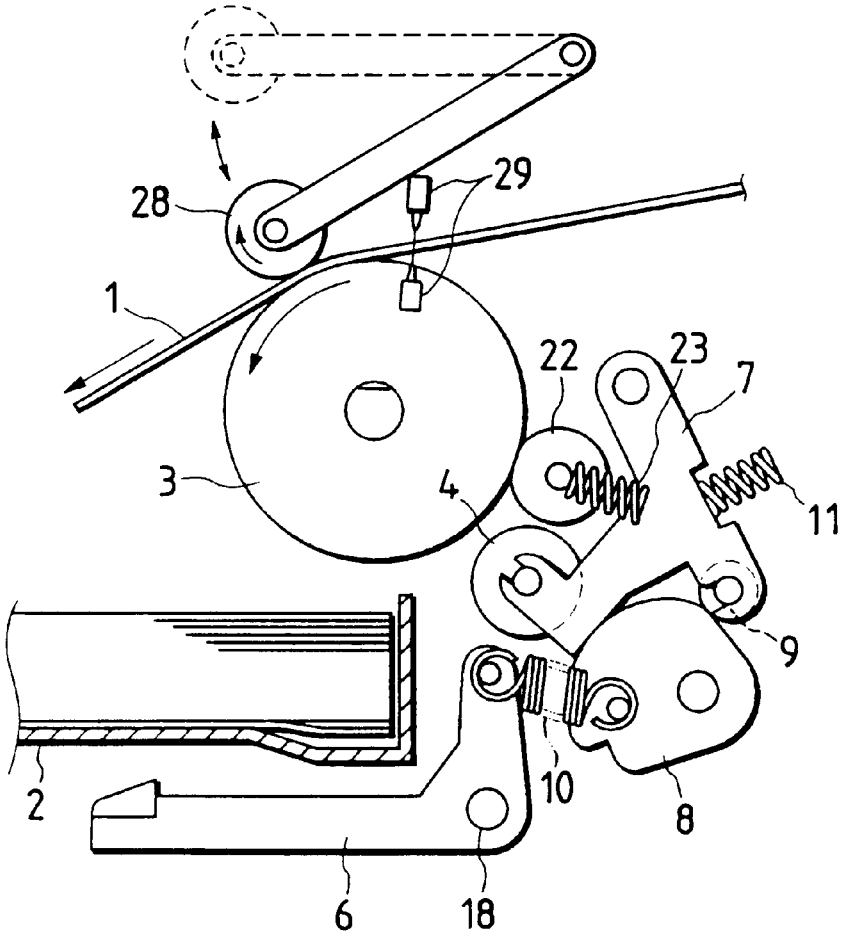
FIG. 27 is a side cross-sectional view of the automatic paper feeder in accordance with a 16th embodiment of the present invention.

FIG. 27 is side cross-sectional view illustrating 1 16th embodiment of the automatic paper feeder in accordance with the present invention. As shown in the drawing, a paper discharge roller 28 is disposed in such a manner as to sandwich the paper discharging passage with the pick roller 3, and is arranged to be moved into contact with or away from the pick roller 3 by an unillustrated means. In addition, the paper discharge roller 28 itself does not have a driving force and is arranged to be rotated by following the rotation of the pick roller 3 as it abuts against the pick roller 3. Further, reference numeral 29 denotes a paper discharge sensor of a transmission type which uses a photo-interrupter for detecting the paper 1 which is discharged after completion of a printing Process. Since the other components and the arrangement thereof are similar to those of the first embodiment, a description thereof will be omitted here.

Next, a description will be given of the operation of the 16th embodiment. When the paper 1 which is discharged after completion of the printing process is located on the paper discharging passage sandwiched by the pick roller 3 and the paper discharge roller 28, the paper discharge sensor 29 detects the same. The unillustrated means is actuated by a signal from the paper discharge sensor 29 to cause the paper discharge roller 28 to abut against the pick roller 3, thereby sandwiching the paper 1 being discharged by the paper discharge roller 28 and the pick roller 3. Then, as the pick roller 3 is rotated in the direction of the arrow, the paper 1 which is sandwiched by the pick roller 3 and the paper discharge roller 28 is transported in the paper discharging direction.

With the conventional apparatus, a driving system for driving the paper discharge roller 28 is provided separately. In accordance with the above-described embodiment, however, the arrangement provided is such that the driving source for driving the paper discharge roller 28 is omitted, the paper discharging operation is effected by the driving source of the pick roller 3, and the pick roller 3 is also used as a paper discharge roller. Hence, a reduction in cost can be expected.

(17th Embodiment)

Figure 28:
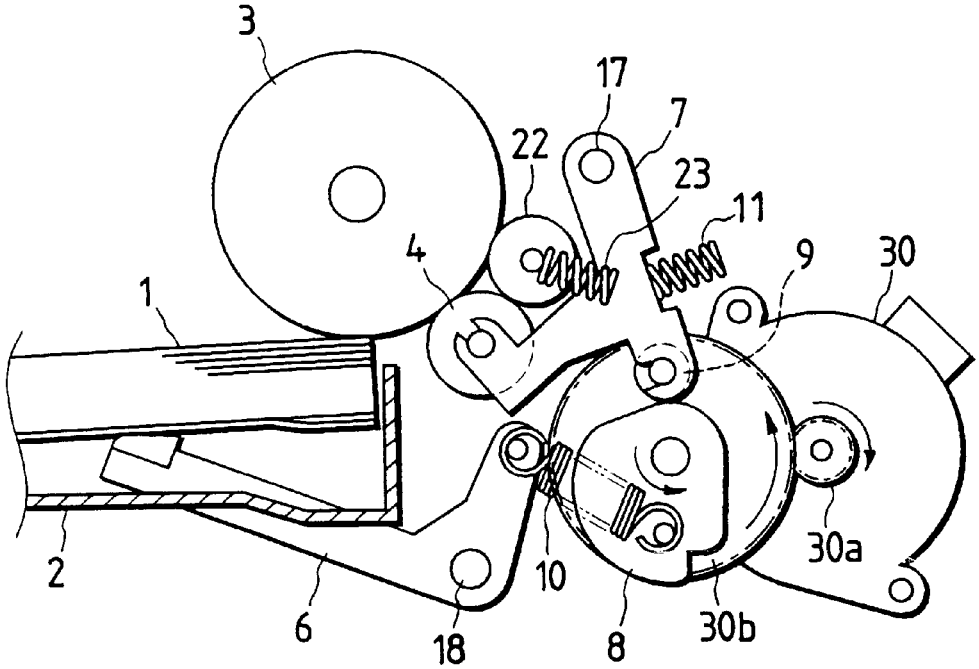
FIG. 28 is a side cross-sectional view of the automatic paper feeder in accordance with a 17th embodiment of the present invention.

FIG. 28 is a side cross-sectional view illustrating an 17th embodiment of the automatic paper feeder in accordance with the present invention. In this arrangement, the step motor 30 is used as the driving means of the cam 8, and if the step motor 30 is driven, the cam 8 is rotated via a motor gear 30*a* and a cam gear 30*b*. If the elongation of the spring 10 connecting the cam 8 and the lifter 6 is varied by controlling the angle of rotation of the cam 8 by managing the amount of driving of the step motor 30, it is possible to vary the contact pressure of the paper 1 raised by the lifter 6 with respect to the pick roller 3. Since the other components and the arrangement thereof are similar to those of the first embodiment, a description thereof will be omitted here.

In accordance with the above-described 17th embodiment, since the arrangement provided is such that the angle of rotation of the cam 8 is made controllable by means of the step motor 30, the paper contacting pressure of the paper 1 with respect to the pick roller 3 can be set to an appropriate paper contacting pressure, respectively, in correspondence with the kind and size of the paper 1 used.

(18th Embodiment)

Figure 29:
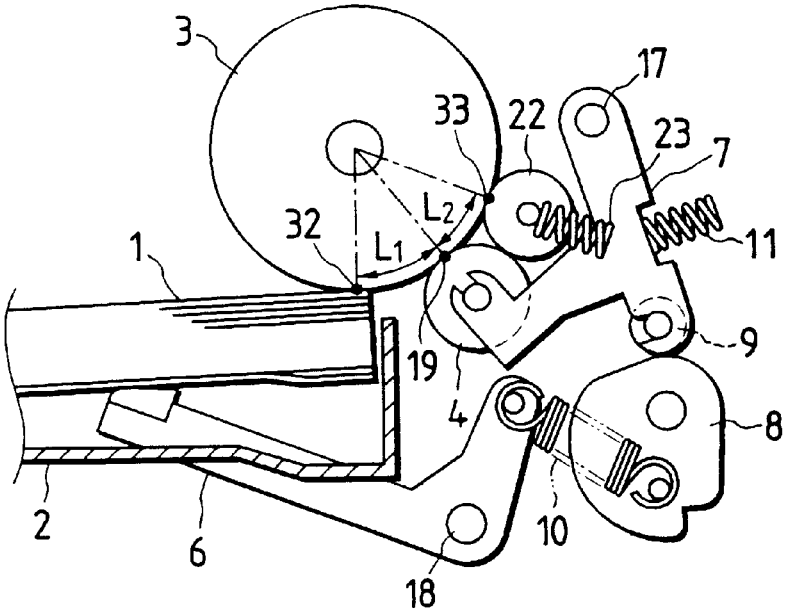
FIG. 29 is a side cross-sectional view of the automatic paper feeder in accordance with an 18th embodiment of the present invention.
Figure 30:
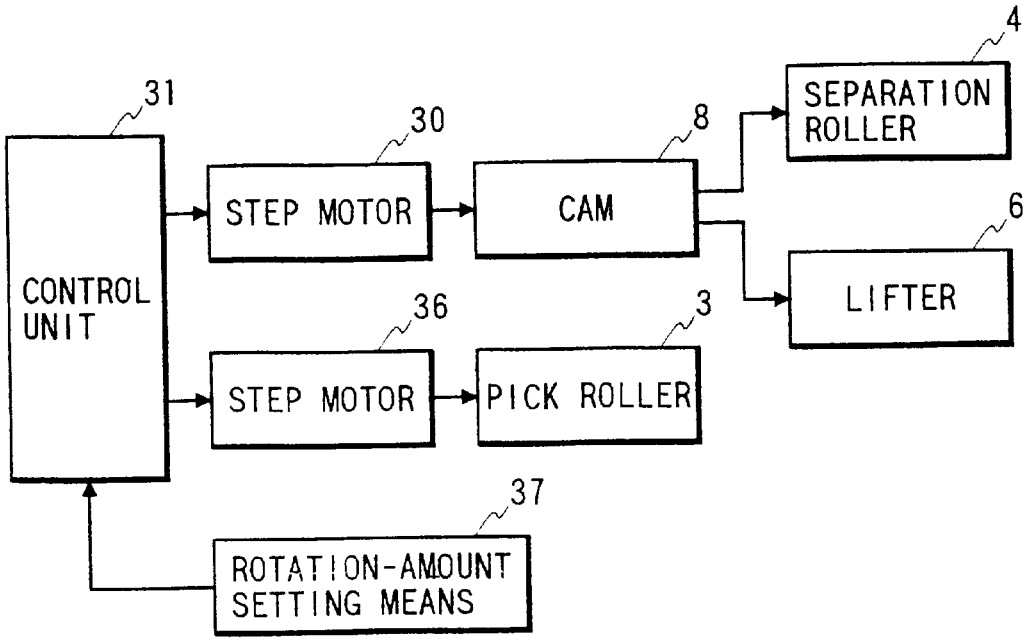
FIG. 30 is a block diagram of a control mechanism section in accordance with the 18th embodiment of the present invention.
Figure 31:
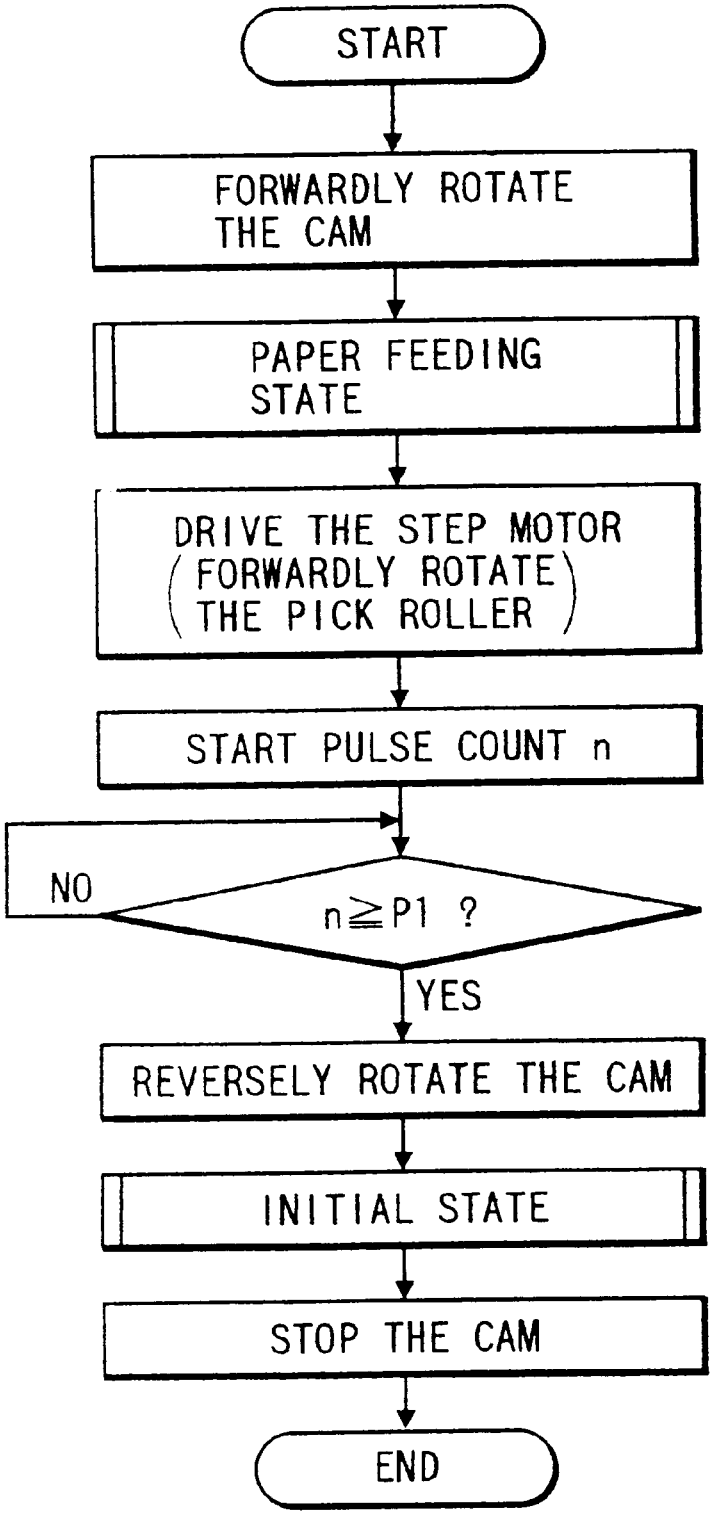
FIG. 31 is a flowchart in accordance with the 18th embodiment of the present invention.

FIG. 29 is a side cross-sectional view illustrating an 18th embodiment of the automatic paper feeder in accordance with the present invention; FIG. 30 is a block diagram of a controlling mechanism unit thereof; and FIG. 31 is a control flowchart thereof. In the drawings, reference numeral 32 denotes a paper picking portion indicating a point where the paper 1 raised by the lifter 6 is brought into contact with the pick roller 3; 33 denotes a paper transporting portion where the feed roller 22 disposed on the downstream side of the separation roller 4 in the traveling direction of the paper 1 is brought into contact with the pick roller 3 driven by the step motor 36; L1 denotes a paper transporting distance from the paper picking portion 32 to the separating portion 19; and L2 denotes a paper transporting distance from the separating portion 19 to the paper transporting portion 33. Numeral 31 denotes a control unit; and 37 denotes a rotation-amount setting means for setting the number P1 of drive pulses necessary for transporting the paper 1 by the distances L1+L2.

Since the other components and the arrangement thereof of this embodiment are similar to those of the fourth embodiment, a description thereof will be omitted.

Next, with reference to the control flowchart shown in FIG. 31, a description will be given of the operation of the 18th embodiment. First, when a signal for starting the paper feeding operation is received by the control unit 31, the cam 8 is driven to cause the separation roller 4 to abut against the pick roller 3. Meanwhile, as the lifter 6 is driven, the paper 1 is brought into contact with the pick roller 3, thereby completing the paper feeding state. (Since the operation up to the completion of the paper feeding state is similar to the first embodiment, a detailed description thereof will be omitted here.)

Next, the step motor 36 is driven to rotate the pick roller 3 in the paper feeding direction. At the same time, the counting of the number of drive pulses of the step motor is started. The number P1 of drive pulses necessary for the pick roller 3 to transport the paper 1 by the distances L1+L2 is set in advance by the rotation-amount setting means 37. Next, after the step motor 36 is driven by a portion corresponding to the number P1 of pulses, the cam 8 is reversely driven to return the lifter 6 and the separation roller 4 to their initial positions (see FIG. 3). Hence, the paper 1 sent to the paper transporting portion 33 is transported to the ensuing step by the feed roller 22.

In accordance with the above-described 18th embodiment, when the paper 1 has been transported by the distances L1+L2 by the pick roller 3, and the paper 1 has been sent to the paper transporting portion 33, the abutment of the separation roller 4 against the pick roller 3 is canceled. Consequently, the distance in which the separation roller 4 is in contact with the paper 1 is the distance L2 from the paper picking portion 32 to the paper transporting portion 33. Thus, the distance in which the separation roller 4 is in contact with the paper 1 can be shortened by setting the value of L2 to a small value, thereby making it possible to reduce the damage caused to the surface of the pick roller 1 as the separation roller 4 is brought into contact with the paper 1.

(21st Embodiment)

Figure 32:
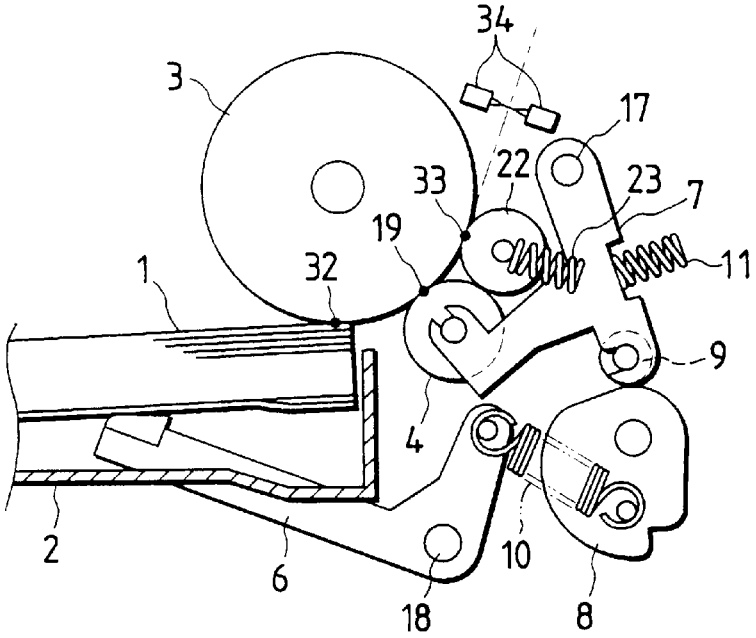
FIG. 32 is a side cross-sectional view of the automatic paper feeder in accordance with a 19th embodiment of the present invention.
Figure 33:
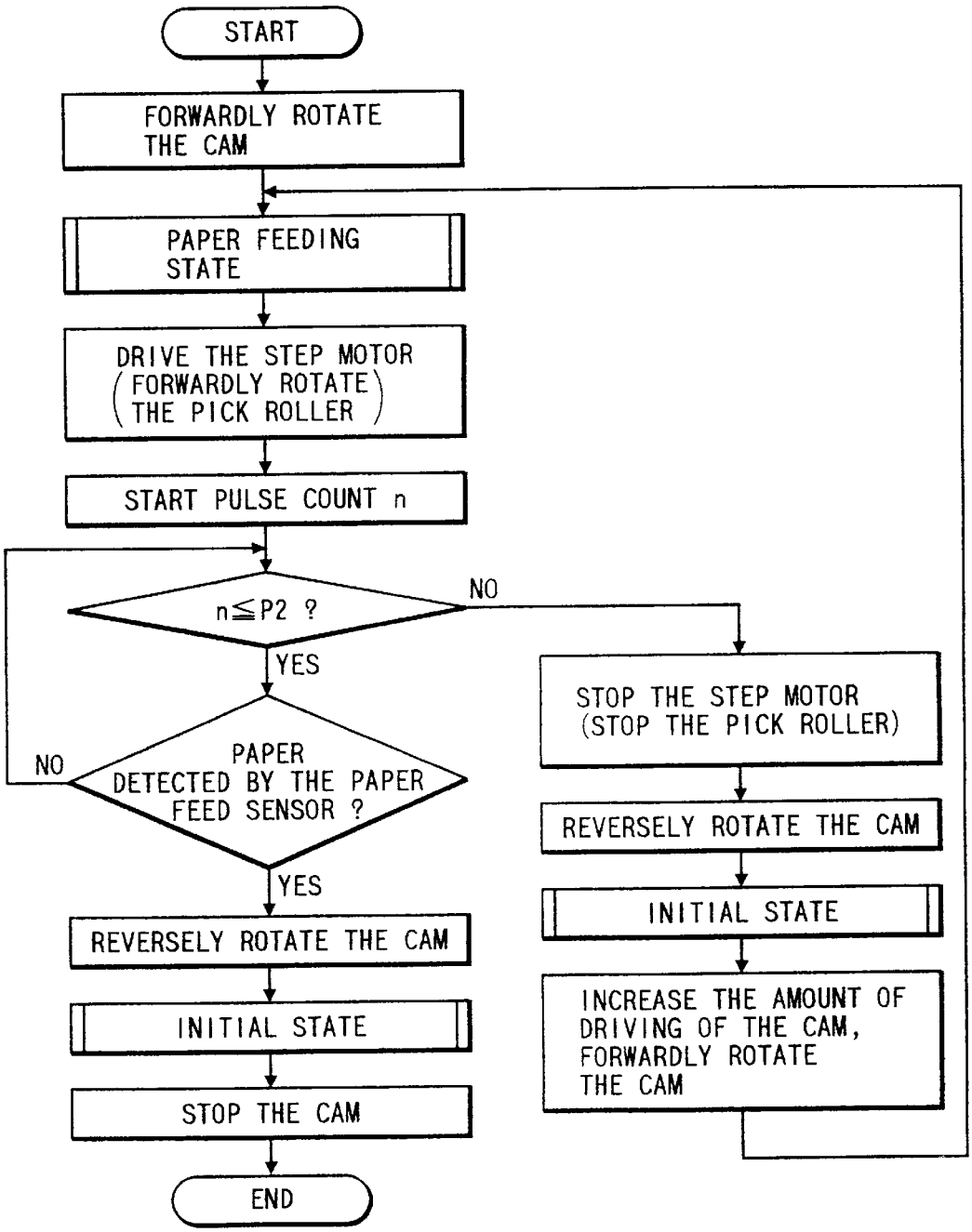
FIG. 33 is a flowchart in accordance with the 19th embodiment of the present invention.

FIG. 32 is a side cross-sectional view illustrating a 19th embodiment of the automatic paper feeder in accordance with the present invention; and FIG. 33 shows a control flowchart of the 19th embodiment. In FIG. 32, reference numeral 34 denotes a paper feed sensor of a transmission type using a photo-interrupter which is a paper detecting means. The paper feed sensor 34 is disposed downstream of the feed roller 22 in the traveling direction of the paper 1. Since the other components and the arrangement thereof are similar to those of the 20th embodiment, a description thereof will be omitted here.

Next, with reference to the control flowchart shown in FIG. 33, a description will be given of the operation of the 19th embodiment. First, after the paper feeding state is completed in the same way as described in the 20th embodiment, the pick roller 3 is rotated in the paper feeding direction by the step motor 36. At this time, the counting of the number of drive pulses of the step motor 36 is started. The number P2 of drive pulses of the step motor 36 necessary for the pick roller 3 to transport the paper 1 from the paper picking portion 32 to the paper feed sensor 34 is set in advance by the rotation-amount setting means 37. If the paper 1 is detected by the paper feed sensor 34 when the counted number of pulses has reached P2, it is determined that the paper 1 has been fed properly.

Next, a description will be given of a case where the paper feed sensor 34 does not detect the paper 1 when the counted number of pulses has reached P2.

If the paper feed sensor 34 does not detect the paper 1, it is determined that a failure to pick out the paper 1 has occurred, so that the rotation of the pick roller 3 is first stopped, and the cam 8 is reversely driven to return the lifter 6 and the separation roller 4 to their initial positions (see FIG. 2). Then, the amount of driving of the cam 8 is increased more than at the time of the aforementioned paper feeding state, and the cam is driven again to cause the separation roller 4 and the paper 1 to abut against the pick roller 3 so as to set the paper feeding state. Subsequently, the pick roller 3 is rotated in the paper feeding direction to resume the paper feeding operation.

In accordance with the above-described 19th embodiment, in the event that an error in picking out the paper 1 by the pick roller 3 has occurred, the amount of driving of the cam 8 is increased, and the operation of picking out the paper 1 by the pick roller 3 is resumed in the state in which the paper-feeding contact pressure produced at the paper picking portion 32 necessary for picking out the paper I is thereby increased. Accordingly, the paper 1 can be taken out reliably.

In the above-described 19th embodiment, if the paper feed sensor 34 does not detect the paper 1, it is determined that an error in picking out the paper 1 by the pick roller 3 has occurred. As an alternative, a description will be given of a case where a misfeeding of the paper 1 has occurred in the paper transporting passage from the paper picking portion 32 to the paper transporting portion 33.

Figure 34:
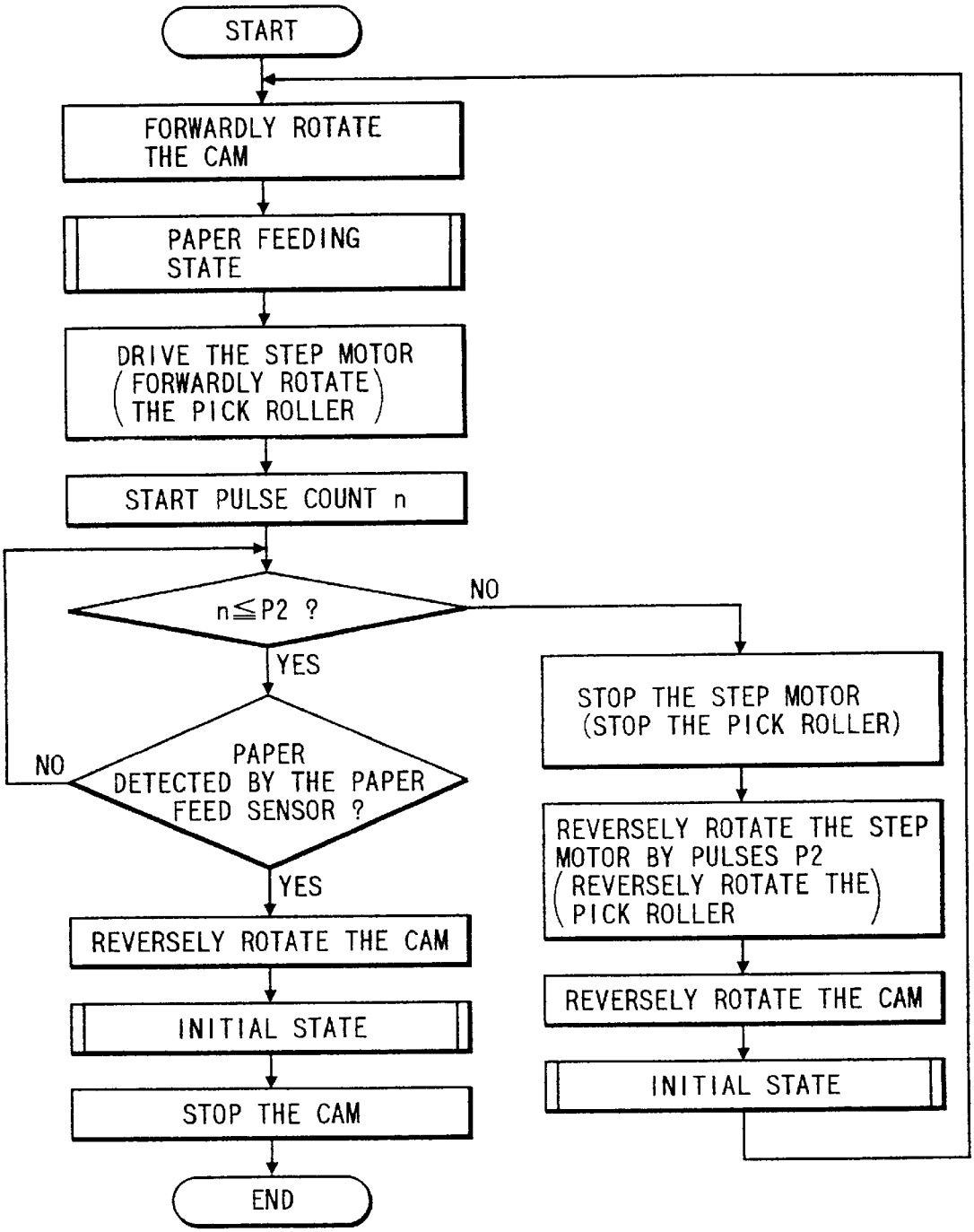
FIG. 34 is an alternative flowchart in accordance with the 19th embodiment of the present invention.

FIG. 34 shows a control flowchart in accordance with this alternative. First, if the paper feed sensor 34 does not detect the paper even if the counted number of pulses has reached the set number P2 of pulses, the rotation of the pick roller is stopped. Then, after the pick roller 3 is rotated in the opposite direction to the paper feeding direction by the set number P2 of pulses, the cam 8 is reversely rotated so as to cancel the abutment of the paper 1 and the separation roller 4 against the pick roller 3 and return the state of operation to the initial state. Control is thus effected to resume the paper feeding operation after the state of operation is set to the initial state.

In accordance with the above-described alternative, if the paper feed sensor 34 does not detect the paper even if the counted number of pulses has reached the set number P2 of pulses, the rotation of the pick roller is stopped, and the pick roller 3 is rotated in the opposite direction to the paper feeding direction by the set number P2 of pulses, thereby making it possible to return the picked paper 1 back into the paper cassette 2.

(20th Embodiment)

Figure 35:
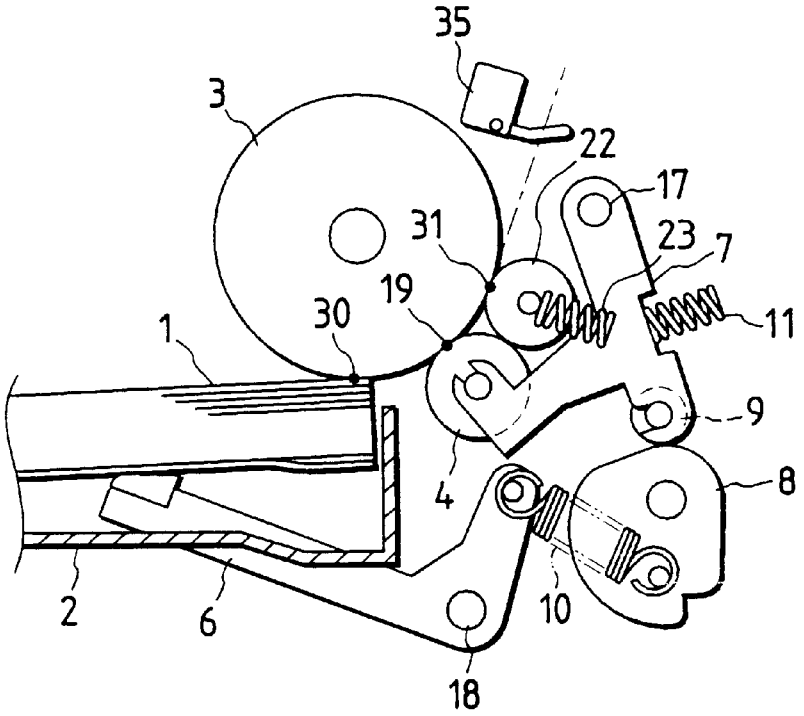
FIG. 35 is a side cross-sectional view of the automatic paper feeder in accordance with a 23rd embodiment of the present invention.
Figure 36:
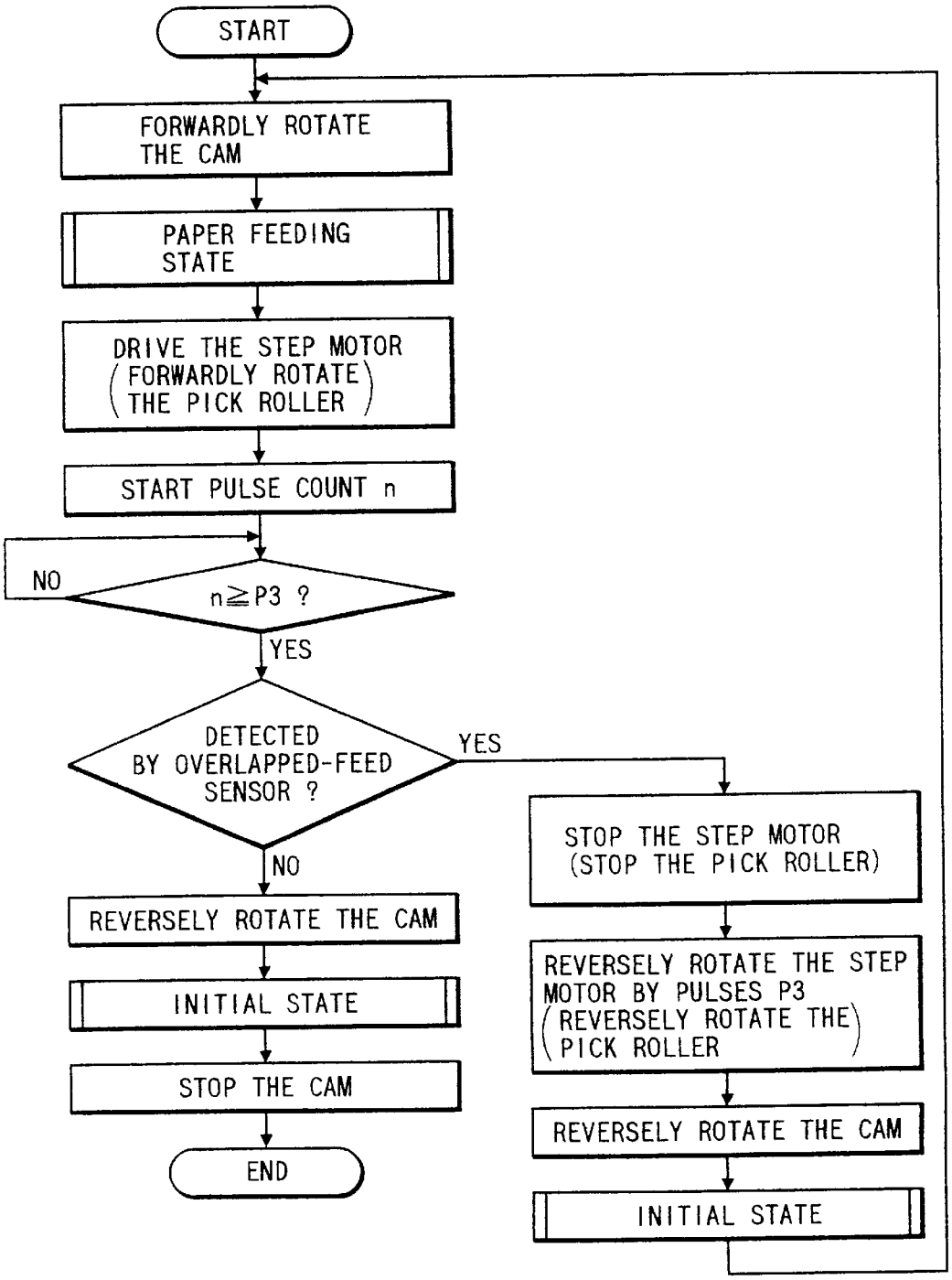
FIG. 36 is a flowchart in accordance with the 20th embodiment of the present invention.

In a 20th embodiment, as shown in FIG. 35, in addition to the arrangement of the 19th embodiment, an overlapped-feed detection sensor 35, which detects the thickness of the paper on the basis of the angle of rotation of an angle sensor so as to detect the overlapped feeding of two or more sheets, is provided downstream of the separating portion 19 in the traveling direction of the paper 1. FIG. 36 shows a control flowchart. In this embodiment, the number P3 of drive pulses of the step motor necessary for the pick roller 3 to transport the paper 1 from the paper picking portion 32 to the overlapped-feed detection sensor 35 is set in advance by the rotation-amount setting means 37. If the paper is detected by the overlapped-feed detection sensor 35, control is provided such that the rotation of the pick roller 3 is stopped, the pick roller 3 is then rotated in the opposite direction to the paper feeding direction by the set number P3 of pulses, and the paper feeding operation is resumed.

In accordance with the above-described 20th embodiment, even if the paper 1 tends to be transported without being separated by the separation roller 4 at the separating portion 19, the overlapped-feed detection sensor 35 detects the same, and after the paper 1 is returned back into the paper cassette 2, the paper feeding operation is resumed and the paper 1 is subjected to the operation of separation by the separation roller 4. Hence, it is possible to reliably prevent an overlapped feeding.

(21st Embodiment)

Figure 37:
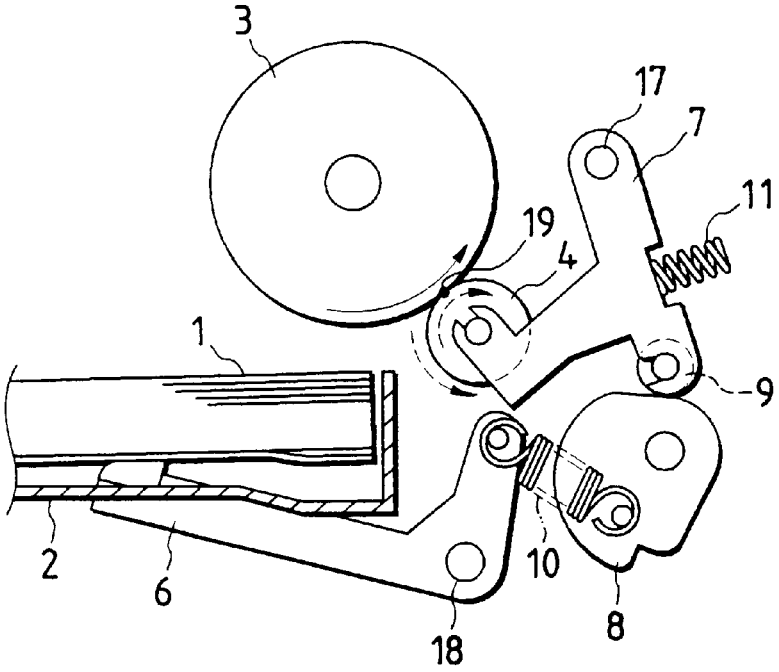
FIG. 37 is a state diagram illustrating the operation in accordance with a 21st embodiment of the present invention.
Figure 38:
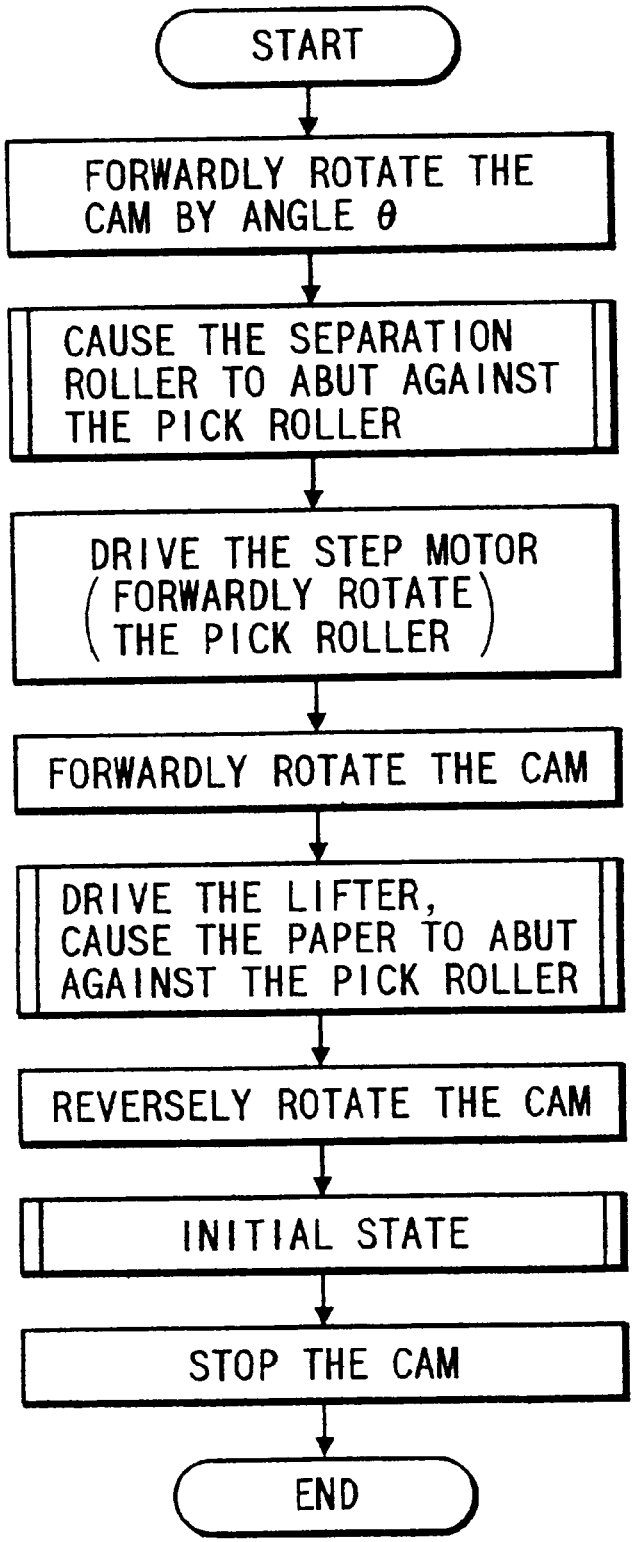
FIG. 38 is a flowchart in accordance with the 24th embodiment of the present invention.
Figure 39:
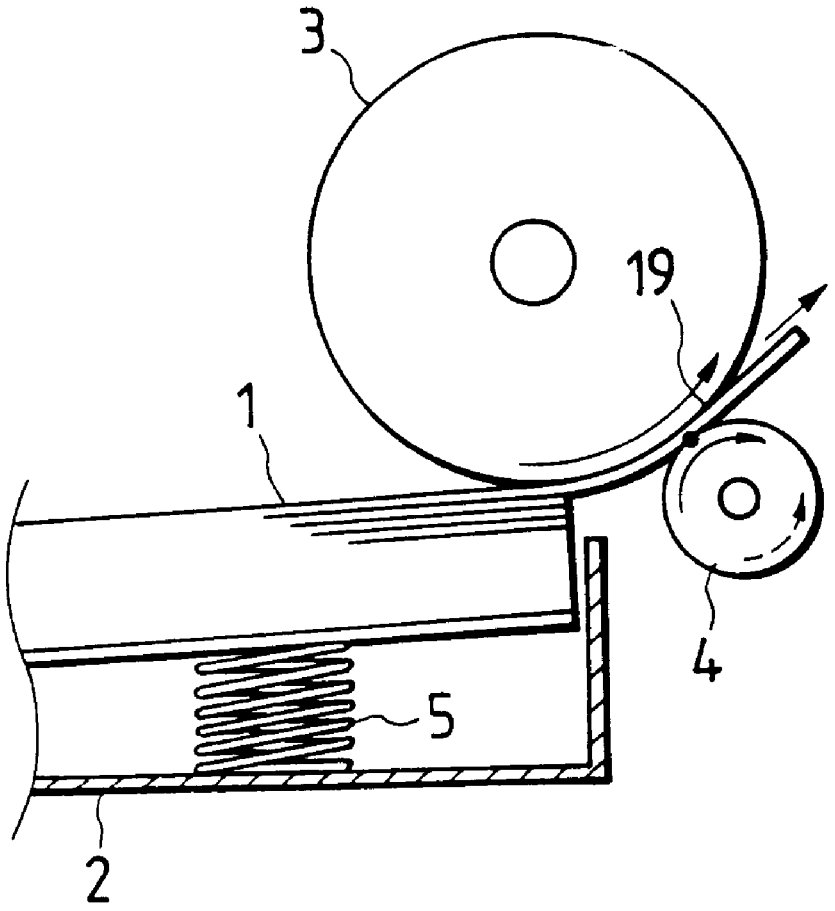
FIG. 39 is a side elevational view illustrating a conventional automatic paper feeder.

FIG. 37 is a diagram illustrating the process of operation of a 21st embodiment of the automatic paper feeder in accordance with the present invention. FIG. 38 shows a control flowchart in accordance with the 21st embodiment. When the cam 8 is rotated an angle q by the step motor 30, the separation roller 4 is made to abut against the pick roller 3. In terms of the amount of driving of the lifter 6 by the cam 8, however, the cam 8 is arranged such that the paper 1 does not come into contact with the pick roller 3. Since the other components and the arrangement thereof are similar to those of the first embodiment, a description thereof will be omitted here.

Next, with reference to the control flowchart shown in FIG. 38, a description will be given of the operation in accordance with the 21st embodiment. First, if the cam 8 is rotated the angle q by the step motor 30, the separation roller 4 is brought into contact with the pick roller 3 to form the separating portion 19. If the angle of rotation of the cam 8 is q, the amount of driving of the lifter 6 is small and the paper 1 does not abut against the pick roller 3. Then, control is effected as follows: After the pick roller 3 is rotated in the paper feeding direction to allow the separation roller 4 to be sufficiently rotated by following the rotation of the pick roller 3, the cam 8 is further rotated to increase the amount of driving of the lifter. This, in turn, causes the paper 1 to abut against the pick roller 3 to form the paper picking portion 32, so as to pick out the paper 1.

Since a separating torque is constantly produced in the separation roller 4 in the opposite direction (in the direction of the dotted line in FIG. 37) to the paper transporting direction, in order to allow the separation roller 4 to be rotated by following the rotation of the pick roller 3, it is necessary to rotate the separation roller 4 in the direction opposite to the direction of the aforementioned separating torque. Therefore, when the paper is advanced into the separating portion 19 at the same time as the pick roller 3 is rotated, there are cases where the separation roller 4 is not sufficiently rotated by following the rotation of the pick roller. In the aforementioned state, when the paper 1 taken out at the paper picking portion 32 is brought into contact with the separation roller 4, there is a possibility that the paper 1 is not transported to the separating portion 19, resulting in a misfeeding such as a jamming. In accordance with the above-described 21st embodiment, however, because control is provided such that the operation of picking out the paper 1 is effected after the separation roller 4 is sufficiently rotated by following the rotation of the pick roller 3, even if the paper 1 is brought into contact with the separation roller, the paper 1 is transported smoothly into the separating portion 19 and a misfeeding is prevented because the separation roller is rotating in the paper feeding direction.

Although the arrangement provided in the above-described 21st embodiment is such that the operation of moving the separation roller 4 into contact with or away from the pick roller 3 and the driving of the lifter 6 are carried out by means of a single driving means, an alternative operation may be provided by using separate driving means as the driving means for the operation of moving the separation roller 4 into contact with or away from the pick roller 3 and the means for driving the lifter 6. In this case as well, control can be provided in such a manner as to effect the operation of picking out the pick roller 1 after the separation roller 4 is rotated by following the rotation of the pick roller 3, and it is possible to obtain an effect similar to that of the 21st embodiment.

In accordance with the invention according to Aspect 1, the automatic paper feeder comprises: separation-roller driving means for moving a separation roller into contact with or away from a pick roller for picking out paper accommodated in the paper cassette; lifter driving means for driving the lifter which moves the paper in the paper cassette to cause the paper to abut against the pick roller; and control means for controlling the separation-roller driving means and the lifter driving means in such a manner as to cause the separation roller and the paper to abut against the pick roller when the paper is fed and to cause the separation roller and the paper to be disengaged from the pick roller when the paper is not fed. Accordingly, since the separation roller does not abut against the pick roller when the paper is not fed, it is possible to prevent an overlapped feeding of the paper in which a plurality of sheets of paper are fed at a time.

In accordance with the invention according to Aspect 2, the two operations, i.e., the operation of moving the separation roller into contact with or away from the pick roller and the operation of driving the lifter, can be interlocked by a single driving means. Hence, it is possible to facilitate control of timings of the operation of moving the separation roller into contact with or away from the pick roller and the operation of driving the lifter.

In addition, since the separation-roller driving means and the lifter driving means can be formed as a single driving means, so that reductions in cost and in the number of components parts used can be expected.

In accordance with the invention according to Aspect 3, the separation roller is supported by a lever which is capable of rotating about an arbitrary point in a plane perpendicular to a plane in a traveling direction of the paper and parallel to the traveling direction of the paper, and a center of rotation of the lever is disposed on a straight line which passes a paper separating portion and which is perpendicular to a straight line connecting a center of rotation of the pick roller and a center of rotation of the separation roller. Therefore, the force for transporting the paper, which occurs at the portion of contact between the pick roller and the separation roller during the separation of the paper, is always directed toward the central axis of rotation of the aforementioned lever, i.e., the center of rotation of the separation roller. Hence, the moment about the axis of rotation of the separation roller due to the force occurring during the separation of the paper becomes zero. Since the effect of the pressure of contact of the separation roller with respect to the pick roller can be eliminated, it is possible to effect a stable separating operation.

In accordance with the invention according to Aspect 4, there is provided a paper-passage preventing member which is arranged such that when the separation roller is at a position in which the separation roller abuts against the pick roller, the paper-passage preventing member is located below a paper separating portion, and when the separation roller is at a position in which the separation roller is retreated from the pick roller, the paper-passage preventing member is in a paper transporting passage and is located above the separation roller. Accordingly, if there is a sheet or sheets of paper which are about to pass the separation roller section when the separation roller is retreated away from the pick roller after completion of the separating operation, since the aforementioned member and the paper interfere with each other, the paper is stopped, thereby making it possible to prevent an overlapped feeding or a misfeeding.

In accordance with the invention according to Aspect 5, since there is provided paper pressing means for pressing the paper toward the paper cassette, this paper pressing means makes it possible to prevent an overlapped feeding in which the paper which has been separated is also transported by following the paper which has been properly transported.

In accordance with the invention according to Aspect 6, a plurality of paper pressing means are provided as the paper pressing means in such a manner as to be located in a vicinity of a paper picking portion and at an equal distance from a center of the paper cassette in an axial direction of the pick roller. Since the paper is pressed uniformly at a plurality of locations, it is possible to further enhance the effect o preventing an overlapped feeding in which the paper which has been separated is also transported by following the paper which has been properly transported.

In accordance with the invention according to Aspect 7, since a feed roller is arranged in such a manner as to be urged by the pick roller, the feed roller is rotated by following the rotation of the pick roller, the feed roller does not require its own driving force, so that a reduction in cost can be expected.

In accordance with the invention according to Aspect 8, there are provided a pair of frictional members disposed on that downstream side, as viewed in the traveling direction of the paper, of the paper cassette which opposes the paper, substantially at positions corresponding to widthwise opposite ends of the paper. Therefore, by virtue of the frictional resistance occurring when the paper is brought into contact with the frictional member, it is possible to obtain the effect of prior separation on the upstream side, as viewed in the transporting direction, of the paper separating portion using the separation roller.

In accordance with the invention according to Aspect 9, since the pair of frictional members are respectively provided on those sides of a pair of paper-width restricting plates disposed in the paper cassette which oppose the paper, the frictional members can be positioned substantially in the vicinities of the opposite ends of the paper irrespective of the size of the paper accommodated in the paper cassette. Hence, it is possible to obtain the effect of prior separation on the upstream side, as viewed in the transporting direction, of the paper separating portion using the separation roller irrespective of the size of the paper. As such, the effect of preventing the overlapped feeding of the paper can be further enhanced.

In accordance with the invention according to Aspect 10, the following arrangement is provided. The pick roller is split into a plurality of rollers disposed on an identical rotating shaft at predetermined intervals and having identical radii, the separation roller being arranged to be capable of being moved into contact with or away from at least one of the split pick rollers, and the feed roller for transporting the paper separated by the separation roller being arranged to be capable of being moved, on a downstream side of the separation roller in the traveling direction of the paper, into contact with or away from at least one of the pick rollers other than the pick roller capable of being moved into contact with or away from the separation roller. If the separation roller and the feed roller are urged against one pick roller, in order to ensure that the separation roller and the feed roller do not interfere with each other, it would be necessary to dispose the feed roller away from the separation roller on the downstream side in the traveling direction of the paper, in which case the paper transporting passage would be raised up high. However, the feed rollers can be disposed in proximity to the separation roller up to a position where the feed roller shaft does not interfere with the separation roller. Hence, the paper transporting passage can be lowered.

In accordance with the invention according to Aspect 11, since a paper guide is arranged in such a manner as to cover front side surface portions, as viewed in the traveling direction of the paper, of the separation roller, it is possible to obtain an advantage in that if a plurality of sheets of paper have tended to enter the paper separating portion, since the paper is brought into contact with the paper guide, the number of sheets entering the paper separating portion can be restricted.

In addition, as the paper fed is brought into contact with the paper guide, the angle of the paper entering the paper separating portion can be corrected to an appropriate angle.

In accordance with the invention according to Aspect 12, since the paper guide is moved by being interlocked with the movement of the separation roller into contact with or away from the pick roller, even if the separated paper is caught by the paper guide, if the separation roller is retreated from the pick roller, the caught paper can be prevented from coming into contact with the pick roller. Hence, an overlapped feeding or a misfeeding can be prevented.

In accordance with the invention according to Aspect 13, since the surface of the paper guide is processed into an uneven surface so as to increase the frictional resistance with respect to the paper, it is possible to enhance the effect of prior separation before the separating operation.

In accordance with the invention according to Aspect 14, since the paper guide has a frictional member provided on the surface thereof, the frictional resistance at the time when the paper is brought into contact with the paper guide can be increased, thereby making it possible to enhance the prior separation effect before the separating operation using the separation roller is effected.

In accordance with the invention according to Aspect 15, since the separation roller is provided with a vane wheel, it is possible to enhance the operation of returning the separated paper back into the paper cassette.

In accordance with the invention according to Aspect 16, since the surface of the separation roller is formed into an uneven surface, it is possible to increase the resistance of contact between the separation roller and the paper and obtain an auxiliary operation at the time of paper separation. In addition, it is possible to reduce paper dust of paper attached to the surface of the separation roller and prevent a decline in the coefficient of friction at the surface of the separation roller.

In accordance with the invention according to Aspect 17, since the separation roller has a frictional member provided on the surface thereof, it is possible to increase the resistance of contact between the separation roller and the paper and obtain an auxiliary operation at the time of paper separation.

In accordance with the invention according to Aspect 18, since a paper discharge passage is disposed on a side of the pick roller which is opposite to a side thereof for paper feeding, and a paper discharge roller is arranged to oppose the pick roller with the paper discharge passage placed therebetween, the paper discharge roller can be driven by the rotation of the pick roller. Hence, the paper discharge roller does not require its own driving force, so that reductions in cost and in the number of components used can be expected.

In accordance with the invention according to Aspect 19, since the amount of driving of the lifter for generating a paper-feeding contact pressure by causing the paper to abut against the pick roller is made variable, if the amount of driving of the lifter is varied in correspondence with the kind of paper loaded in the paper cassette, the paper-feeding contact pressure during the picking of the paper can be set to a level suited to the kind of paper used. Hence, a stable paper-picking operation becomes possible.

In accordance with the invention according to Aspect 20, control is provided as follows: When the paper which has passed the paper separating portion is transported to the paper transporting portion, i.e., a point of contact between the feed roller and the pick roller, the separation roller is retreated, and the paper-feeding contact pressure between the paper and the pick roller is canceled. Therefore, the distance in which the separation roller is brought into contact with the paper becomes equal to the distance of the section ranging from the paper separating portion to the paper transporting portion. Therefore, the section in which the surface of the paper is damaged due to the contact between the separation roller and the paper is limited to the aforementioned section, thereby making it possible to shorten the range in which the paper is damaged by the separation roller.

In accordance with the invention according to Aspect 21, paper detecting means is provided on a downstream side of the feed roller in the traveling direction of the paper, and the amount of rotation of the pick roller necessary for transporting the paper to the paper detecting means is set in advance. If the paper is not detected within the set amount of driving, the amount of driving of the lifter is increased to increase the paper-feeding contact pressure, and the paper feeding operation is then resumed. Hence, the paper picking operation can be carried out reliably.

In accordance with the invention according to Aspect 22, since control is provided such that if the paper is not detected within the set amount of driving of the pick roller after the start of the paper feeding operation, the pick roller is rotated in an opposite direction to the paper feeding direction by the set amount of driving, and the feeding of the paper is then resumed. Accordingly, it is possible to return the paper back into the paper cassette.

In accordance with the invention according to Aspect 23, means for detecting an overlapped feeding of the paper is disposed downstream of the paper separating portion in the traveling direction of the paper, and control is provided such that when the overlapped feeding has been detected by the overlapped-feed detecting means, the pick roller is reversely rotated to return the paper back into the paper cassette, and the paper feeding operation is then resumed. Therefore, an overlapped feeding can be prevented reliably.

In accordance with the invention according to Aspect 24, since the arrangement provided is such that the separation roller is sufficiently rotated by following the rotation of the pick roller before the paper in the paper cassette is made to abut against the pick roller, even if the paper fed from the paper picking portion is brought into contact with the separation roller, since the separation roller is rotating in the paper transporting direction, the paper can be fed smoothly into the paper separating portion, so that it is possible to prevent the jamming of paper, the bending of a leading end of the paper, and the like.

What is claimed is:

1. An automatic paper feeder comprising:

a pick roller for picking out paper accommodated in a paper cassette and propelling the paper in a paper-feeding direction;

pick roller driving means for causing said pick roller to rotate to pick paper out of said paper cassette;

a separation roller for separating multiple sheets of paper picked out of said paper cassette at the same time by said pick roller such that the paper is propelled in the paper-feeding direction one sheet at a time, said separation roller being configured to rotate in the paper-feeding direction when a single sheet of paper is picked out of said paper cassette by said pick roller and to separate multiple sheets of paper by rotating opposite to the paper-feeding direction when multiple sheets of paper are picked out of said paper cassette at the same time;

separation roller driving means for moving said separation roller into contact with or away from said pick roller;

a lifter for moving the paper accommodated in said paper cassette into contact with or away from said pick roller;

lifter driving means for driving said lifter;

a driving source for driving said separation roller driving means and said lifter driving means; and control means for controlling said separation roller driving means and said lifter driving means in such a manner as a) to cause said separation roller and the paper to abut against said pick roller when the paper is to be fed; and b) to cause said separation roller and the paper to be disengaged from said pick roller when the paper is not to be fed;

wherein said pick roller driving means and said driving source are independent of each other such that said separation roller and the paper can be moved into contact with or away from said pick roller independently of rotation of said pick roller.

2. The automatic paper feeder of claim 1, wherein an identical driving source is used as said driving source for driving said separation-roller driving means and said lifter driving means, and said separation-roller driving means and said lifter driving means are interlocked.

3. The automatic paper feeder of claim 1, further comprising:

a feed roller which opposes said pick roller downstream of said separation roller in a traveling direction of the paper, is brought into contact with said pick roller, and adapted to transport the paper separated by said separation roller.

* * * * *